US010894408B2

(12) United States Patent
Takabe et al.

(10) Patent No.: US 10,894,408 B2
(45) Date of Patent: Jan. 19, 2021

(54) LIQUID DISCHARGING HEAD AND LIQUID DISCHARGING APPARATUS

(71) Applicant: SEIKO EPSON CORPORATION, Tokyo (JP)

(72) Inventors: Motoki Takabe, Shiojiri (JP); Eiju Hirai, Azumino (JP); Yuma Fukuzawa, Matsumoto (JP); Shunya Fukuda, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/358,548

(22) Filed: Mar. 19, 2019

(65) Prior Publication Data

US 2019/0291429 A1 Sep. 26, 2019

(30) Foreign Application Priority Data

Mar. 20, 2018 (JP) ..... 2018-053278

(51) Int. Cl.
*B41J 2/14* (2006.01)

(52) U.S. Cl.
CPC ..... *B41J 2/14233* (2013.01); *B41J 2/14201* (2013.01); *B41J 2002/14491* (2013.01)

(58) Field of Classification Search
CPC ..... B41J 2/14233; B41J 2/14201; B41J 2002/14491; B41J 2002/14362; B41J 2002/14411; B41J 2202/12; B41J 2202/11; B41J 2002/14419
See application file for complete search history.

(56) References Cited

U.S. PATENT DOCUMENTS

2007/0091150 A1* 4/2007 Kodama ..... B41J 2/04543 347/68
2008/0238980 A1 10/2008 Nagashima et al.
2011/0228012 A1 9/2011 Yoshida et al.
2012/0176450 A1 7/2012 Akahane et al.
2014/0292954 A1 10/2014 Hirabayashi et al.
2016/0059559 A1 3/2016 Nakamura
2016/0059562 A1 3/2016 Yoshioka et al.

FOREIGN PATENT DOCUMENTS

JP 2008-149594 A 7/2008
JP 2008-254196 A 10/2008
JP 2011-131533 A 7/2011
JP 2011-213094 A 10/2011
(Continued)

*Primary Examiner* — Justin Seo
(74) *Attorney, Agent, or Firm* — Workman Nydegger

(57) ABSTRACT

A liquid discharging head includes a first flow path member comprising a first flow path and a pressure chamber; a second flow path member stacked on the first flow path member and comprising a second flow path; a wiring substrate comprising a connection terminal for electrically connected to a driving element to generate a pressure change in the pressure chamber; and a circulation flow path for circulating the liquid through the pressure chamber. A surface of the first flow path member includes a first region which is stacked on the second flow path member via the wiring substrate and a second region which is stacked on the second flow path member without the wiring substrate. The first flow path and the second flow path are in communication with each other in the second region so as to be the circulation flow path.

20 Claims, 14 Drawing Sheets

(56) References Cited

FOREIGN PATENT DOCUMENTS

| | | | |
|---|---|---|---|
| JP | 2012-143948 | A | 8/2012 |
| JP | 2014-188837 | A | 10/2014 |
| JP | 2015-066864 | A | 4/2015 |
| JP | 2015-134507 | A | 5/2015 |
| JP | 2016-049675 | A | 4/2016 |
| JP | 2016-049678 | A | 4/2016 |

* cited by examiner

LIQUID DISCHARGING HEAD AND LIQUID DISCHARGING APPARATUS

BACKGROUND

1. Technical Field

The present invention relates to a technique for discharging a liquid such as ink.

2. Related Art

There is known a liquid discharging head which discharges a liquid such as ink in a pressure chamber by a driving element such as a piezoelectric element from a nozzle. For example, JP-A-2016-049678 discloses a head in which a flow path member in which a flow path communicating with a nozzle or the like is formed and a wiring substrate are joined via a photosensitive resin layer, and a circulation flow path (communication hole on a supply side and communication hole on a collection side) is formed so as to penetrate the flow path member, the wiring substrate, and the photosensitive resin layer. An electronic component such as a connection terminal for driving the piezoelectric element is mounted on a surface of the wiring substrate, so that the wiring substrate has an uneven surface. Therefore, in JP-A-2016-049678, the photosensitive resin layer is interposed between the flow path member and the wiring substrate, a space is formed in the photosensitive resin layer, and the uneven surface of the wiring substrate is disposed in the space. Such a photosensitive resin layer functions as an adhesive layer for joining the flow path member and the wiring substrate.

However, as disclosed in JP-A-2016-049678, in a case where the circulation flow path is formed so as to penetrate a flow path forming substrate and the wiring substrate, since the circulation flow path penetrates not only the flow path forming substrate and the wiring substrate but also the photosensitive resin layer therebetween, the photosensitive resin layer is exposed to the circulation flow path. Therefore, depending on a type of ink flowing through the circulation flow path, the photosensitive resin layer swells or reacts due to contact between the liquid and the photosensitive resin layer to lower the strength. Therefore, there is a concern that the strength of the liquid discharging head is lowered.

SUMMARY

According to an aspect of the invention, there is provided a liquid discharging head including: a first flow path member in which a pressure chamber communicating with a nozzle for discharging a liquid is formed; a second flow path member that is stacked on the first flow path member so as to overlap each other in a first direction; a wiring substrate in which a connection terminal electrically connected to a driving element for generating a pressure change in the pressure chamber is disposed; and a circulation flow path for circulating the liquid of the pressure chamber. A surface of the first flow path member includes a first region which is stacked on the second flow path member via the wiring substrate and a second region which is stacked on the second flow path member without the wiring substrate. A surface of the second flow path member is joined to the surface of the first flow path member so as to overlap the first region and the second region. The circulation flow path is formed by communicating a first flow path formed in the first flow path member and a second flow path formed in the second flow path member in the second region.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
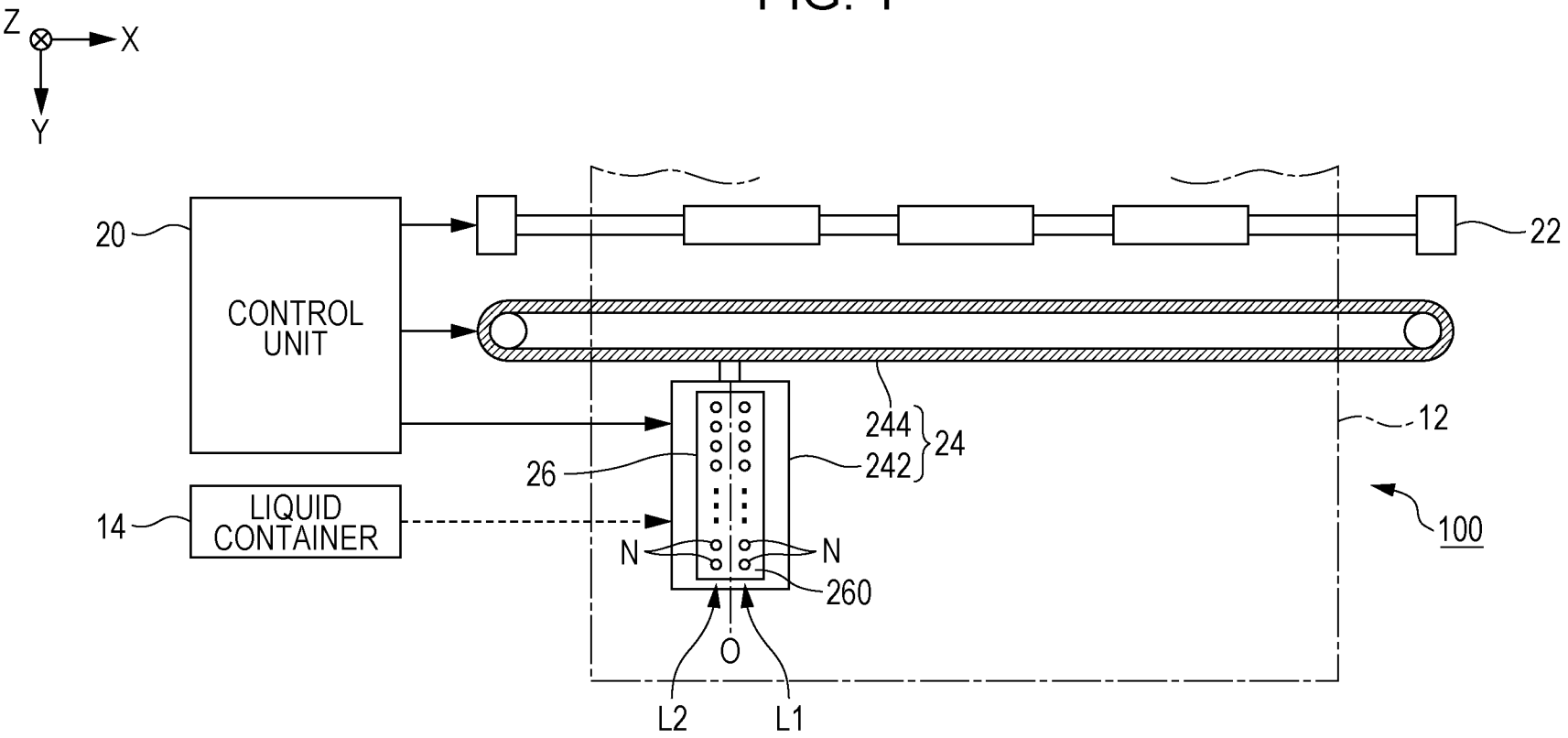
FIG. 1 is a view of a configuration of a liquid discharging apparatus according to a first embodiment of the invention.

FIG. 1 is a view of a partial configuration of a liquid discharging apparatus 100 according to a first embodiment of the invention. The liquid discharging apparatus 100 of the first embodiment is a printing apparatus of an ink jet type for discharging ink that is an example of a liquid onto a medium 12 such as a printing sheet. The medium 12 is a typical printing sheet, but a printing target of any material such as a resin film or cloth can be the medium 12. The liquid discharging apparatus 100 illustrated in FIG. 1 includes a control unit 20, a transport mechanism 22, a moving mechanism 24, and a liquid discharging head 26. A liquid container 14 for storing ink is mounted on the liquid discharging apparatus 100.

The liquid container 14 is a cartridge of an ink tank type made of a box-shaped container capable of being mounted on a body of the liquid discharging apparatus 100. Moreover, the liquid container 14 is not limited to the box-shaped container, but may be a cartridge of an ink pack type made of a bag-like container. In addition, an ink tank capable of replenishing ink can be used as the liquid container 14. Ink is stored in the liquid container 14. The ink may be a dye ink containing a dye as a coloring material or a pigment ink containing a pigment as a coloring material. In addition, the ink may be black ink or color ink. The ink stored in the liquid container 14 is pressure-fed by a pump (not illustrated) to the liquid discharging head 26.

The control unit 20 includes, for example, a processing circuit such as a Central Processing Unit (CPU) or a Field Programmable Gate Array (FPGA) and a storage circuit such as a semiconductor memory, and controls each element of the liquid discharging apparatus 100 in an integrated manner. The transport mechanism 22 transports the medium 12 in a Y direction under a control of the control unit 20.

The moving mechanism 24 reciprocates the liquid discharging head 26 in an X direction under a control of the control unit 20. The X direction is a direction intersecting (typically orthogonal) the Y direction in which the medium 12 is transported. The moving mechanism 24 of the first embodiment includes a substantially box-shaped carriage 242 (transport body) for accommodating the liquid discharging head 26 and a transport belt 244 to which the carriage 242 is fixed. Moreover, a configuration in which a plurality of liquid discharging heads 26 is loaded on the carriage 242, or a configuration in which the liquid container 14 is loaded on the carriage 242 together with the liquid discharging head 26.

The liquid discharging head 26 discharges the ink supplied from the liquid container 14 to the medium 12 from a plurality of nozzles N (discharging holes) under a control of the control unit 20. A desired image is formed on a surface of the medium 12 by the liquid discharging head 26 discharging the ink onto the medium 12 in parallel with the transport of the medium 12 by the transport mechanism 22 and repetitive reciprocation of the carriage 242. Moreover, hereinafter, a direction perpendicular to an X-Y plane (for example, a plane parallel to the surface of the medium 12) is referred to as a Z direction. A discharging direction (typically a vertical direction) of the ink by the liquid discharging head 26 corresponds to the Z direction. The Z direction of the embodiment is an example of a first direction, the X direction is an example of a second direction intersecting the first direction, and the Y direction is an example of a third direction intersecting a virtual plane (corresponding to an X-Z plane) including the first direction and the second direction.

As illustrated in FIG. 1, the plurality of nozzles N of the liquid discharging head 26 are formed in a discharging surface 260 (surface facing the medium 12). The plurality of nozzles N are arranged in the Y direction. The plurality of nozzles N of the first embodiment are divided into a first nozzle row L1 and a second nozzle row L2 which are juxtaposed at intervals in the X direction. Each of the first nozzle row L1 and the second nozzle row L2 is an aggregate of the plurality of nozzles N which are linearly arranged in the Y direction. Moreover, it is also possible to make the positions of respective nozzles N in the Y direction between the first nozzle row L1 and the second nozzle row L2 different (that is, zigzag arrangement or staggered arrangement), but a configuration in which the positions of respective nozzles N in the Y direction coincide with each other in the first nozzle row L1 and the second nozzle row L2 is exemplified for the sake of convenience.

Liquid Discharging Head

Figure 2:
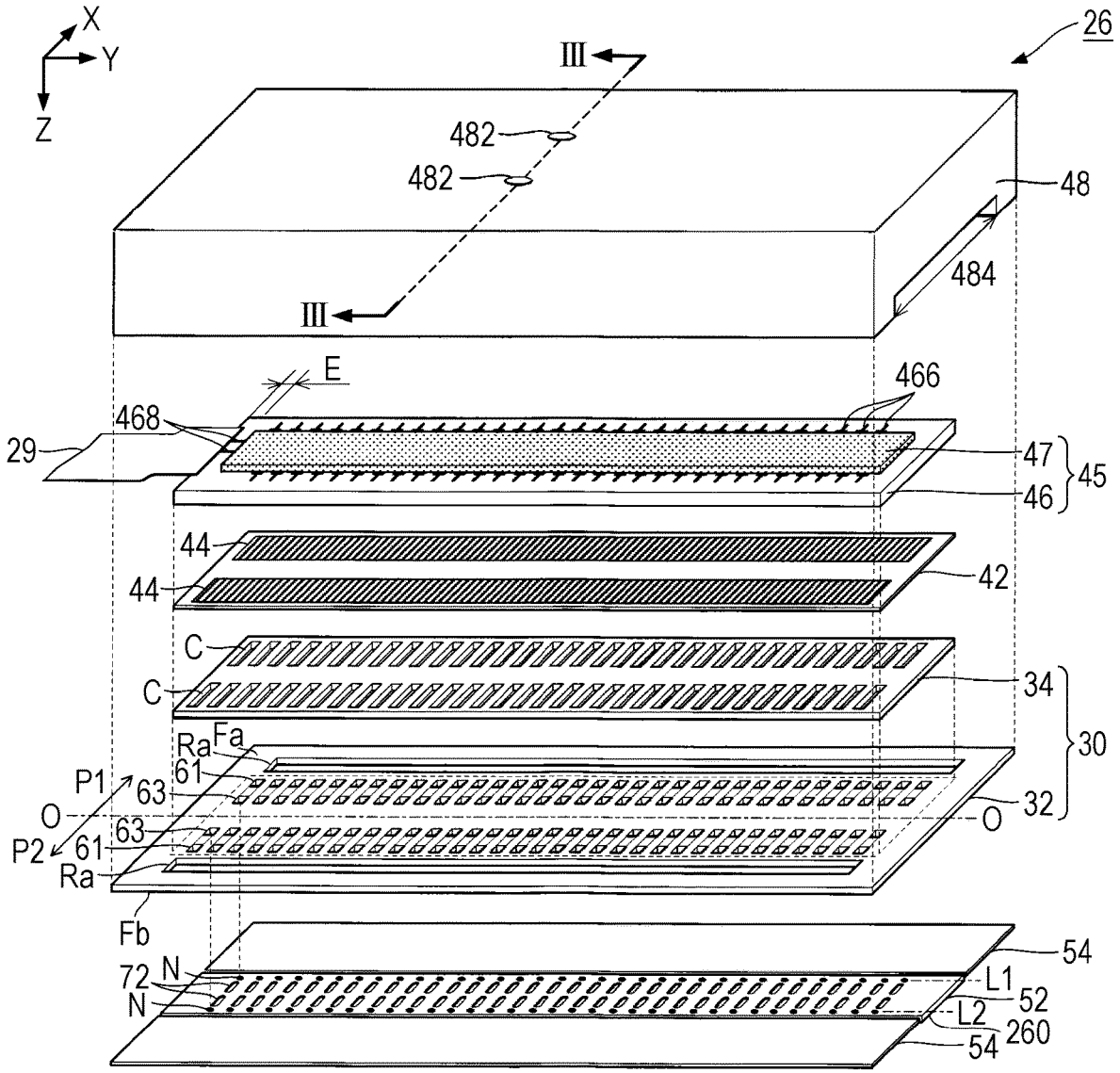
FIG. 2 is an exploded perspective view of a liquid discharging head.
Figure 3:
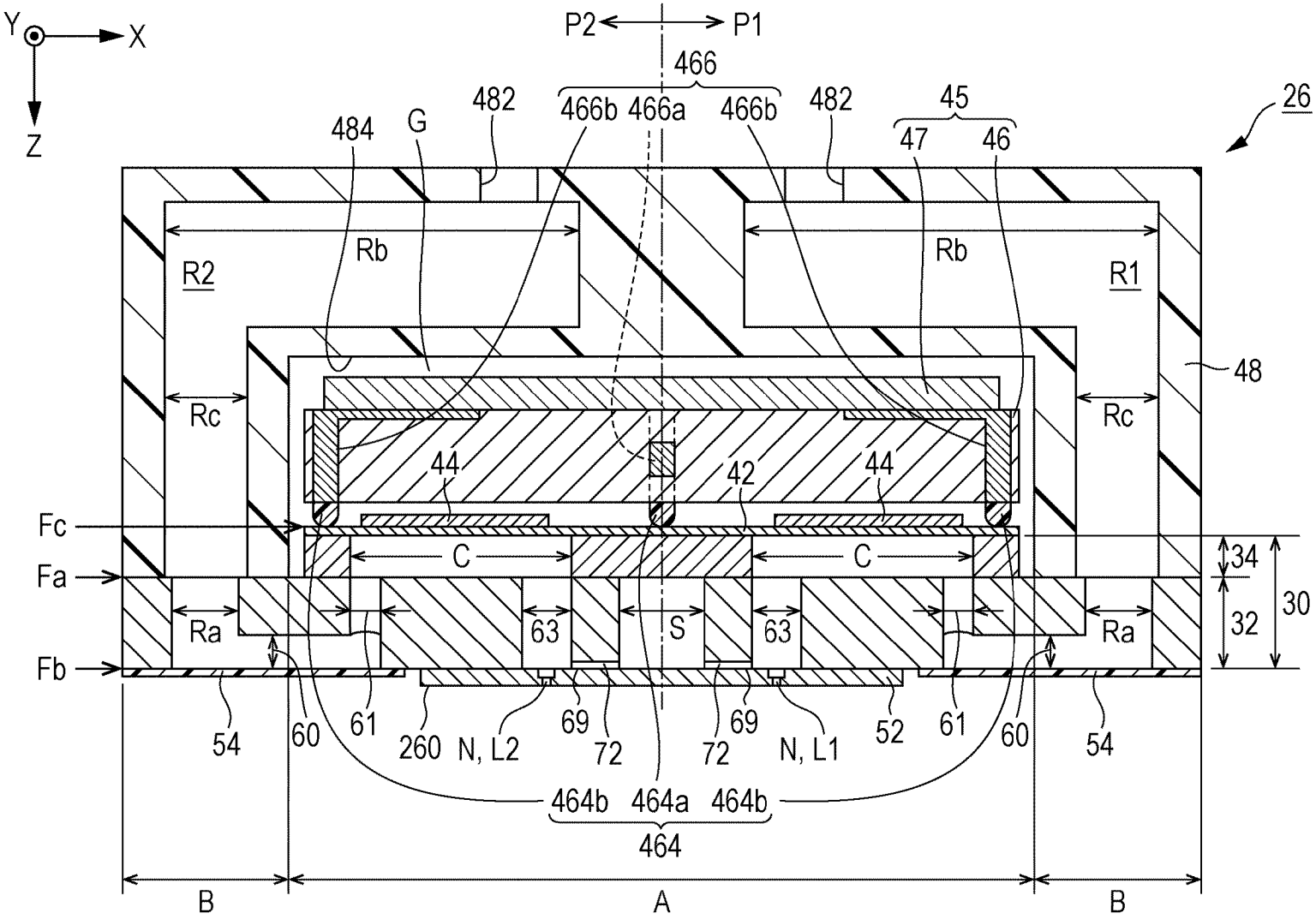
FIG. 3 is a sectional view which is taken along line III-III of the liquid discharging head illustrated in FIG. 2.
Figure 4:
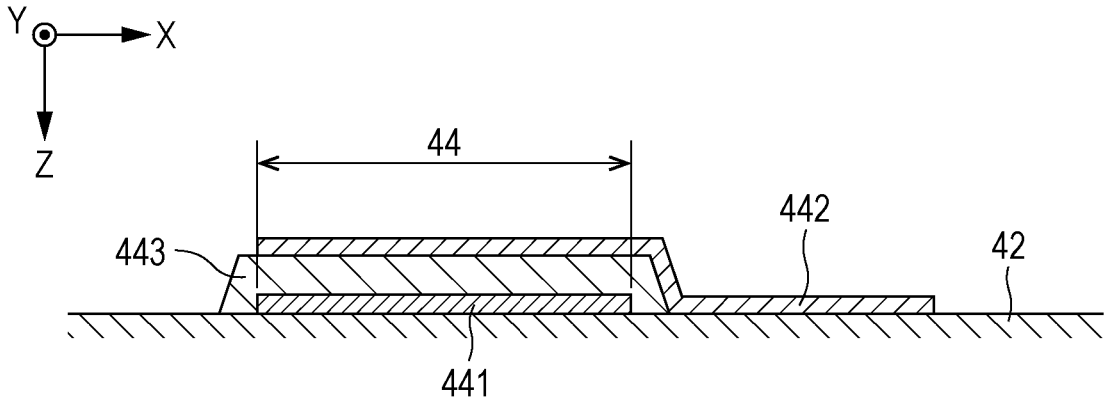
FIG. 4 is a sectional view of a piezoelectric element.

FIG. 2 is an exploded perspective view of the liquid discharging head 26 and FIG. 3 is a sectional view of a case where the liquid discharging head 26 is cut in a cross section of III-III in the Y direction. FIG. 4 is a sectional view of a piezoelectric element 44. As illustrated in FIGS. 2 and 3, the liquid discharging head 26 of the embodiment has a structure in which an element related to each nozzle N (example of a first nozzle) of the first nozzle row L1 and an element related to each nozzle N (example of a second nozzle) of the second nozzle row L2 are disposed plane-symmetrically with a virtual plane O interposed between. That is, structures of a portion (hereinafter, referred to as "first portion") P1 on a positive side in the X direction and a portion (hereinafter, referred to as "second portion") P2 on a negative side in the X direction across the virtual plane O in the liquid discharging head 26 are substantially common. The plurality of nozzles N of the first nozzle row L1 are formed in the first portion P1 and the plurality of nozzles N of the second nozzle row L2 are formed in the second portion P2. The virtual plane O corresponds to a boundary surface between the first portion P1 and the second portion P2.

The liquid discharging head 26 includes a first flow path member 30 and a second flow path member 48. The first flow path member 30 has a structure in which a flow path for supplying the ink is formed in the plurality of nozzles N. The first flow path member 30 and the second flow path member 48 are stacked so as to overlap each other in the Z direction. The first flow path member 30 of the first embodiment is constituted by stacking a communication plate 32, a pressure chamber substrate 34, and a vibrating portion 42. Each of the communication plate 32, the pressure chamber substrate 34, and the vibrating portion 42 a plate-like member elongated in the Y direction.

As illustrated in FIG. 3, a surface of the first flow path member 30 on a negative side in the Z direction includes a first region A stacked on the second flow path member 48 via a wiring substrate 45 and a second region B stacked on the second flow path member 48 without the wiring substrate 45. Further, the communication plate 32 is provided over the first region A and the second region B. The pressure chamber substrate 34 and the vibrating portion 42 of the embodiment are joined to a surface Fa (upper surface) of the communication plate 32 on the negative side in the Z direction in this order by adhesive or the like, and are disposed in the first region A.

The surface Fa of the communication plate 32 is provided with a plurality of piezoelectric elements 44, the wiring substrate 45, and the second flow path member 48 in addition to the pressure chamber substrate 34 and the vibrating portion 42. The plurality of piezoelectric elements 44 and the wiring substrate 45 of the embodiment are provided on the surface of the vibrating portion 42 on the negative side in the Z direction and are disposed in the first region A. The second flow path member 48 of the embodiment is stacked on the first flow path member 30 so as to overlap the first region A and the second region B, and is joined to the second region B by adhesive or the like on the surface Fa of the communication plate 32. Moreover, details of specific arrangement configuration of the plurality of piezoelectric elements 44, the wiring substrate 45, and the like will be described later.

On the other hand, a surface Fb of the communication plate 32 on the positive side (that is, a side opposite to the surface Fa) in the Z direction is provided with a nozzle plate 52 and a vibration absorber 54. Each element of the liquid discharging head 26 is a plate-like member elongated in the Y direction substantially similar to the communication plate 32 and the pressure chamber substrate 34, and is joined together by adhesive or the like. Each plate-like element constituting the liquid discharging head 26 of the embodiment is stacked in the Z direction that is a direction perpendicular to a surface of each element, so that, for example, a direction in which the communication plate 32 and the pressure chamber substrate 34 are stacked, and a direction in which the communication plate 32 and the nozzle plate 52 are stacked correspond to the Z direction.

The nozzle plate 52 is a plate-like member in which the plurality of nozzles N are formed, and is joined to the surface Fb of the communication plate 32 by adhesive or the like. A surface of the nozzle plate 52 on a side opposite to a surface on a communication plate 32 side is the discharging surface 260 facing the medium 12. Each of the plurality of nozzles N is a cylindrical through-hole penetrating from the discharging surface 260 to the surface on the communication plate 32 side. The plurality of nozzles N constituting the first nozzle row L1 and the plurality of nozzles N constituting the second nozzle row L2 are formed in the nozzle plate 52 of the first embodiment. Specifically, the plurality of nozzles N of the first nozzle row L1 are formed along the Y direction in a region on the positive side in the X direction as viewed from the virtual plane O, and the plurality of nozzles N of the second nozzle row L2 are formed along the Y direction in a region of the nozzle plate 52 on the negative side in the X direction. The nozzle plate 52 of the first embodiment is a single plate-like member continuous over a portion in which the plurality of nozzles N of the first nozzle row L1 are formed and a portion in which the plurality of nozzles N of the second nozzle row L2 are formed. The nozzle plate 52 of the first embodiment is manufactured by processing a single crystal substrate of silicon (Si) using a semiconductor manufacturing technique (for example, a processing technique such as dry etching or wet etching). However, known materials and manufacturing methods can be applied to the manufacture of the nozzle plate 52.

As illustrated in FIGS. 2 and 3, a space Ra, a supply liquid chamber 60, a plurality of supply paths 61, and a plurality of communication paths 63 are formed at each of the first portion P1 and the second portion P2 in the communication plate 32. The space Ra is an opening elongated along the Y direction in plan view (that is, viewed in the Z direction), and the supply path 61 and the communication path 63 are through-holes formed for each nozzle N. The supply liquid chamber 60 is a space elongated along the Y direction over the plurality of nozzles N, and allows the space Ra and the plurality of supply paths 61 to communicate with each other. The plurality of communication paths 63 are arranged in the Y direction in plan view and the plurality of supply paths 61 are arranged in the Y direction between the arrangement of the plurality of communication paths 63 and the space Ra. The plurality of supply paths 61 commonly communicate with the space Ra. In addition, any one of the communication paths 63 overlaps the nozzle N corresponding thereto in plan view. Specifically, any one of the communication paths 63 at the first portion P1 communicates with one nozzle N of the first nozzle row L1 corresponding to any one of the communication paths 63. Similarly, any one of the communication paths 63 at the second portion P2 communicates with one nozzle N of the second nozzle row L2 corresponding to any one of the communication paths 63.

The pressure chamber substrate 34 is a plate-like member in which a plurality of pressure chambers C (cavities) are formed at each of the first portion P1 and the second portion P2. The plurality of pressure chambers C are arranged in the Y direction. Each of the pressure chambers C is a space elongated along the X direction in plan view formed for each nozzle N. Similar to the nozzle plate 52 described above, the communication plate 32 and the pressure chamber substrate 34 are manufactured by processing a single crystal substrate of silicon, for example, using the semiconductor manufacturing technique. However, known materials and manufacturing methods can be applied to the manufacture of the communication plate 32 and the pressure chamber substrate 34. As described above, in the first embodiment, the first flow path member 30 (communication plate 32 and pressure chamber substrate 34) and the nozzle plate 52 include a substrate formed of silicon. Therefore, for example, as described above, a fine flow path can be formed with high accuracy in the first flow path member 30 and the nozzle plate 52 by using the semiconductor manufacturing technique.

The vibrating portion 42 is provided on a surface of the pressure chamber substrate 34 on a side opposite to the communication plate 32. The vibrating portion 42 of the first embodiment is a vibration plate capable of elastically vibrating. Moreover, a part of a region corresponding to the pressure chamber C in the plate-like member having a predetermined plate thickness is selectively removed in a thickness direction of the plate, and thereby the pressure chamber substrate 34 and the vibrating portion 42 can be integrally formed. The vibrating portion 42 can be constituted by a simple substance of a Si layer or a stacked body of a plurality of layers including the Si layer. The stacked layer body of the plurality of layers including the Si layer includes a stacked body of the Si layer and a SiO2 layer, a stacked body of the Si layer, the SiO2 layer, and a ZrO2 layer, or the like.

The surface Fa of the communication plate 32 and the vibrating portion 42 face each other with intervals on an inside of each of the pressure chambers C. The pressure chamber C is a space positioned between the surface Fa of the communication plate 32 and the vibrating portion 42, and a pressure change is generated in the ink with which the space is filled. Each of the pressure chambers C is, for example, a space in which the X direction is a longitudinal direction and is individually formed for each nozzle N. The plurality of pressure chambers C are arranged in the Y direction for each of the first nozzle row L1 and the second nozzle row L2. In the configuration of FIGS. 2 and 3, an end portion of any one of the pressure chambers C on the virtual plane O side in plan view overlaps the communication path 63 and an end portion thereof on a side opposite to the virtual plane O overlaps the supply path 61. Therefore, in each of the first portion P1 and the second portion P2, the pressure chamber C communicates with the nozzle N via communication path 63 and communicates with the space Ra via supply path 61. Moreover, a predetermined flow path resistance may be added by forming a throttle flow path narrowing a flow path width in the pressure chamber C.

As illustrated in FIGS. 2 and 3, the plurality of piezoelectric elements 44 corresponding to different nozzles N are provided on the surface of the vibrating portion 42 on a side opposite to the pressure chamber C for each of the first portion P1 and the second portion P2. The piezoelectric element 44 is a passive element that is deformed by a supply of a driving signal. The plurality of piezoelectric elements 44 are arranged in the Y direction so as to correspond to each of the pressure chambers C. When the vibrating portion 42 vibrates in conjunction with the deformation of the piezoelectric element 44 to which the driving signal is supplied, a pressure in the pressure chamber C corresponding to the piezoelectric element 44 varies, so that the ink with which the pressure chamber C is filled communicates with the communication path 63 and the nozzle N to be discharged.

As illustrated in FIG. 4, any one of the piezoelectric elements 44 is a driving element formed of a stacked body where a piezoelectric layer 443 is interposed between a first electrode 441 and a second electrode 442 facing each other.

An overlapped portion of the first electrode 441, the second electrode 442, and the piezoelectric layer 443 in plan view functions as the piezoelectric element 44. Moreover, a portion (that is, an active portion that vibrates the vibrating portion 42) deformed by the supply of the driving signal can be defined as the piezoelectric element 44. One of the first electrode 441 and the second electrode 442 can be an electrode (that is, a common electrode) continuous over the plurality of piezoelectric elements 44, and the other thereof can be an individual electrode which is individual for each of the plurality of piezoelectric elements 44. In the embodiment, a case where the first electrode 441 is the common electrode and the second electrode 442 is the individual electrode is exemplified. Moreover, a wiring structure for driving the piezoelectric element 44 will be described later.

The second flow path member 48 illustrated in FIGS. 2 and 3 is a case member for storing the ink supplied to the plurality of pressure chambers C (furthermore, the plurality of nozzles N). The surface of the second flow path member 48 on the positive side in the Z direction is joined to the surface Fa of the communication plate 32 by adhesive or the like. The second flow path member 48 is formed of a material different from that of the first flow path member 30. For example, it is possible to manufacture the second flow path member 48 by injection molding of a resin material.

As illustrated in FIG. 3, the second flow path member 48 of the first embodiment is formed of a space Rb and a space Rc elongated along the Y direction for each of the first portion P1 and the second portion P2. The space Rc is longer than the space Rb in the Z direction and the space Rb is longer than the space Rc in the X direction. The space Rc extends from the space Rb to the space Ra of the communication plate 32 and communicates with the space Rb and the space Ra. A space constituted of the space Ra, the space Rb, and the space Rc is a circulation flow path for circulating the ink of the plurality of pressure chambers C, and functions as a common liquid chamber (reservoir) for supplying the ink to the plurality of pressure chambers C.

In the embodiment, a space constituted of the space Ra, the space Rb, and the space Rc on a first portion P1 side is referred to as a first circulation flow path R1, and a space constituted of the space Ra, the space Rb, and the space Rc on a second portion P2 side is referred to as a second circulation flow path R2. The first circulation flow path R1 is a circulation flow path on a flow-in side for supplying the ink to the plurality of pressure chambers C on the first portion P1 side, and the second circulation flow path R2 is a circulation flow path on a flow-in side for supplying the ink to the plurality of pressure chambers C on the second portion P2 side.

The first circulation flow path R1 is positioned on the positive side in the X direction as viewed from the virtual plane O, and the second circulation flow path R2 is positioned on the negative side in the X direction as viewed from the virtual plane O. A surface of the second flow path member 48 on a side opposite to the communication plate 32 is formed of a connection port 482 for introducing the ink supplied from the liquid container 14 into the first circulation flow path R1, and a connection port 482 for introducing the ink supplied from the liquid container 14 into the second circulation flow path R2. The ink in the first circulation flow path R1 is supplied to the pressure chamber C on the first portion P1 side via supply liquid chamber 60 and each of the supply paths 61 on the first portion P1 side. The ink in the second circulation flow path R2 is supplied to the pressure chamber C on the second portion P2 side via supply liquid chamber 60 and each of the supply paths 61 on the second portion P2 side.

The vibration absorber 54 is provided on the surface Fb of the communication plate 32 for each of the first portion P1 and the second portion P2. The vibration absorber 54 is formed of a flexible film (compliance substrate). The vibration absorber 54 of the first portion P1 absorbs a pressure fluctuation of the ink in the first circulation flow path R1 and the vibration absorber 54 of the second portion P2 absorbs a pressure fluctuation of the ink in the second circulation flow path R2. As illustrated in FIG. 3, the vibration absorber 54 of the first portion P1 is provided on the surface Fb of the communication plate 32 so as to close the space Ra of the communication plate 32 and the plurality of supply paths 61 of the first portion P1, and constitutes a wall surface (specifically, a bottom surface) of the first circulation flow path R1. The vibration absorber 54 of the second portion P2 is provided on the surface Fb of the communication plate 32 so as to close the space Ra of the communication plate 32 and the plurality of supply paths 61 of the second portion P2, and constitutes a wall surface (specifically, a bottom surface) of the second circulation flow path R2.

The surface Fb of the communication plate 32 facing the nozzle plate 52 is formed of a circulating liquid chamber S. The circulating liquid chamber S of the first embodiment is an elongated bottomed hole (groove portion) extending in the Y direction in plan view. An opening of the circulating liquid chamber S is closed by the nozzle plate 52 joined to the surface Fb of the communication plate 32. The circulating liquid chamber S is a part of a circulation flow path for circulating the ink between the pressure chamber C and the first circulation flow path R1 of the first portion P1, and between the pressure chamber C and the second circulation flow path R2 of the second portion P2. The circulating liquid chamber S functions as a circulation flow path on a flow-out side for allowing the ink to flow out from the pressure chamber C of the first portion P1 and the pressure chamber C of the second portion P2. The surface of the second flow path member 48 on a side opposite to the communication plate 32 is provided with the connection port 482 communicating with the circulating liquid chamber S, and the ink from the circulating liquid chamber S may be introduced from the connection port 482.

Circulation Path

Figure 5:
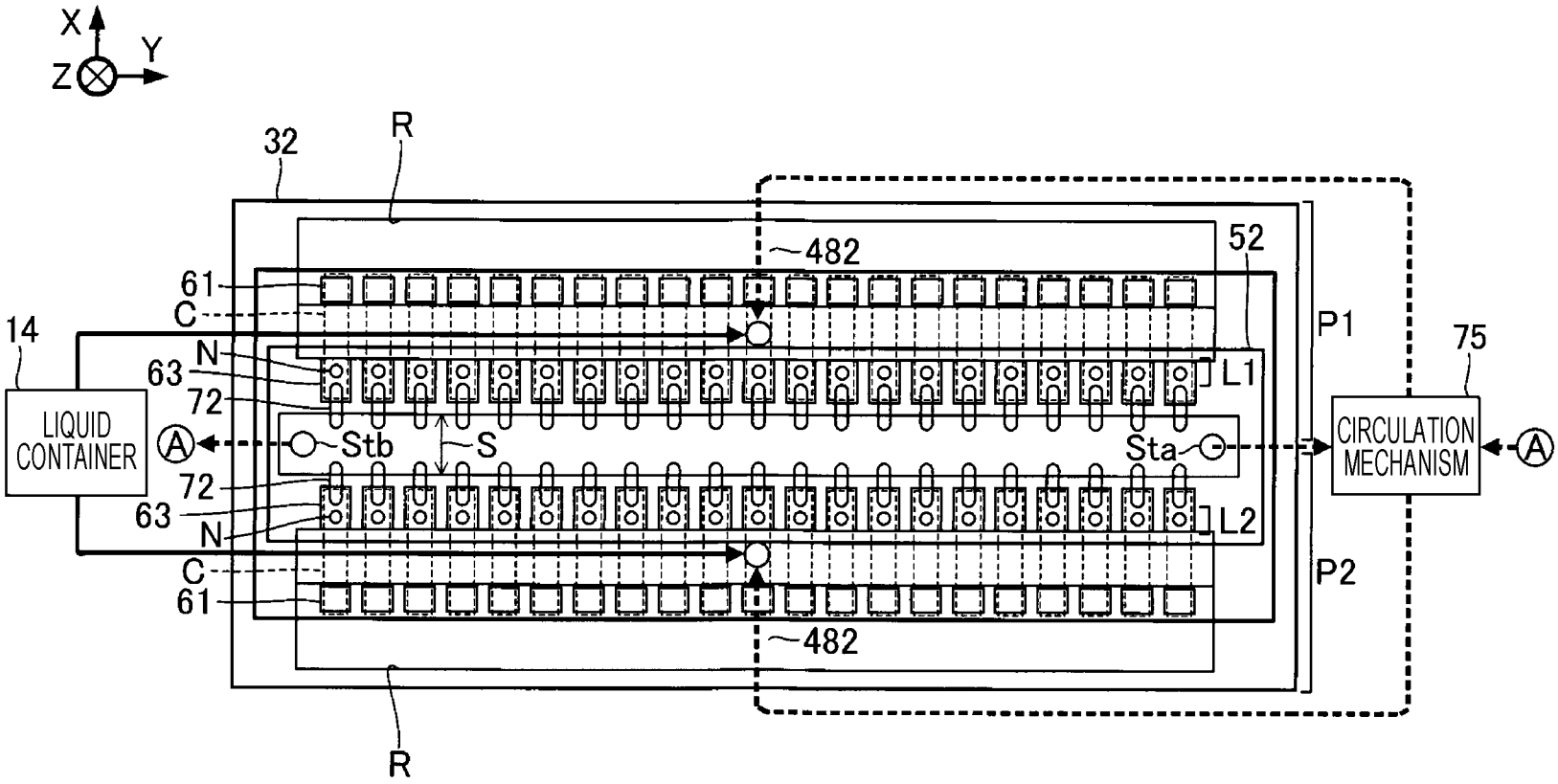
FIG. 5 is a view of a configuration of the liquid discharging head focused on a circulating liquid chamber.

Next, a configuration of a circulation path of the embodiment will be described. FIG. 5 is a view of a configuration of the liquid discharging head 26 focused on the circulation path. As illustrated in FIG. 5, the circulating liquid chamber S is continuous over the plurality of nozzles N along the first nozzle row L1 and the second nozzle row L2. Specifically, the circulating liquid chamber S is formed between the nozzles N of the first nozzle row L1 and the nozzles N of the second nozzle row L2. Therefore, as illustrated in FIGS. 2 and 3, the circulating liquid chamber S is positioned between the communication path 63 of the first portion P1 and the communication path 63 of the second portion P2. As described above, the first flow path member 30 of the first embodiment is a structure in which the pressure chamber C (first pressure chamber) and the communication path 63 (first communication path) at the first portion P1, the pressure chamber C (second pressure chamber) and the communication path 63 (second communication path) at the second portion P2, and the circulating liquid chamber S positioned between the communication path 63 of the first portion P1 and the communication path 63 of the second portion P2. The first flow path member 30 of the embodiment includes a partition wall portion 69 that is a wall-like portion for partitioning between the circulating liquid chamber S and each of the communication paths 63.

Moreover, as described above, in the embodiment, the plurality of pressure chambers C and the plurality of piezoelectric elements 44 are arranged in the Y direction in each of the first portion P1 and the second portion P2. Therefore, the circulating liquid chamber S extends in the Y direction so as to be continuous over the plurality of pressure chambers C or the plurality of piezoelectric elements 44 in each of the first portion P1 and the second portion P2. In the first portion P1, the circulating liquid chamber S and the first circulation flow path R1 extend in the Y direction with an interval each other in the X direction, and the pressure chamber C, the communication path 63, and the nozzle N of the first portion P1 are positioned in the interval in the X direction. In the second portion P2, the circulating liquid chamber S and the second circulation flow path R2 extend in the Y direction with an interval each other in the X direction, and the pressure chamber C, the communication path 63, and the nozzle N of the second portion P2 are positioned in the interval in the X direction.

Figure 6:
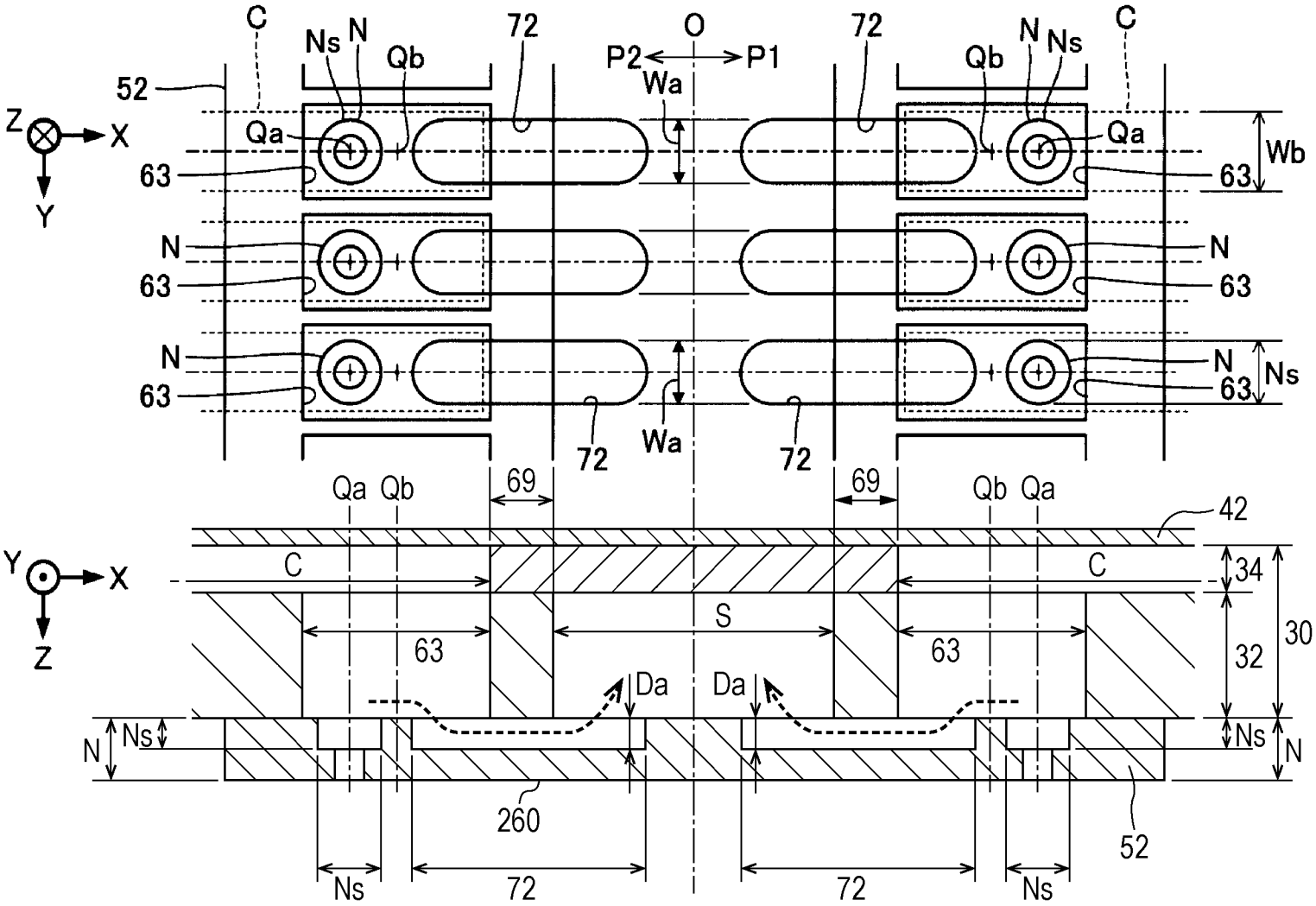
FIG. 6 is a plan view and a sectional view in which a portion in a vicinity of the circulating liquid chamber is enlarged.

FIG. 6 is an enlarged plan view and a sectional view of a portion of the liquid discharging head 26 in a vicinity of the circulating liquid chamber S. As illustrated in FIG. 6, a central axis Qa of each nozzle N is positioned on a side opposite to the circulating liquid chamber S as viewed from a central axis Qb of the communication path 63. The surface of the nozzle plate 52 facing the first flow path member 30 is formed of a plurality of circulating communication paths 72 in each of the first portion P1 and the second portion P2. The plurality of circulating communication paths 72 of the first portion P1 correspond one to one to the plurality of nozzles N of the first nozzle row L1 (or, the plurality of communication paths 63 corresponding to the first nozzle row L1). In addition, the plurality of circulating communication paths 72 of the second portion P2 correspond one to one to the plurality of nozzles N of the second nozzle row L2 (or, the plurality of communication paths 63 corresponding to the second nozzle row L2).

Moreover, each of the plurality of nozzles N may be a through-hole penetrating from the surface of the discharging surface 260 on the communication plate 32 side to the surface of the nozzle plate 52 with a uniform diameter, but as illustrated in FIG. 6, may be a through-hole having an enlarged diameter portion Ns of which a diameter is enlarged in the middle thereof. The enlarged diameter portion Ns of FIG. 6 opens to the surface of the nozzle plate 52 on the communication plate 32 side and has the diameter larger than an opening diameter of the nozzle N opening to the discharging surface 260. As described above, it becomes easy to set the flow path resistance of each nozzle N to a desired characteristic by making each nozzle N the through-hole having the enlarged diameter portion Ns.

Each of the circulating communication paths 72 is a groove portion (that is, an elongated bottomed hole) extending in the X direction, and functions as a flow path through which the ink circulates. The circulating communication path 72 is formed at a position (specifically, on the circulating liquid chamber S side as viewed from the nozzle N corresponding to the circulating communication path 72) separated from the nozzle N. For example, the plurality of nozzles N and the plurality of circulating communication paths 72 are collectively formed in a common process by the semiconductor manufacturing technique (for example, a processing technique such as dry etching or wet etching). Of course, the circulating communication path 72 may be provided in the communication plate 32 without being provided in the nozzle plate 52.

Each of the circulating communication paths 72 is linearly formed with a flow path width Wa equivalent to that of the enlarged diameter portion of the nozzle N. In addition, the flow path width (dimension in the Y direction) Wa of the circulating communication path 72 in the first embodiment is smaller than a flow path width (dimension in the Y direction) Wb of the pressure chamber C. Therefore, it is possible to increase the flow path resistance of the circulating communication path 72 compared to a case where the flow path width Wa of the circulating communication path 72 is larger than the flow path width Wb of the pressure chamber C. On the other hand, a height Da of the circulating communication path 72 with respect to the surface of the nozzle plate 52 is constant over an entire length, and is formed to have the same height as that of the enlarged diameter portion Ns of the nozzle N. Therefore, the circulating communication path 72 and the enlarged diameter portion of the nozzle N are easily formed compared to a case where the circulating communication path 72 and the enlarged diameter portion Ns of the nozzle N are formed to have different depths. Moreover, the "height" of the flow path means a dimension (for example, a difference in height between a forming surface of the flow path and a bottom surface of the flow path) of the flow path in the Z direction.

Any one of the circulating communication paths 72 in the first portion P1 is positioned on the circulating liquid chamber S side as viewed from the nozzle N corresponding to any one of the circulating communication paths 72 in the first nozzle row L1. In addition, any one of the circulating communication paths 72 in the second portion P2 is positioned on the circulating liquid chamber S side as viewed from the nozzle N corresponding to any one of the circulating communication paths 72 in the second nozzle row L2. An end portion of each of the circulating communication paths 72 on the communication path 63 side on the side opposite to the virtual plane O overlaps one communication path 63 corresponding to the circulating communication path 72 in plan view. That is, the circulating communication path 72 communicates with the communication path 63. On the other hand, the end portion of each of the circulating communication paths 72 on the circulating liquid chamber S side that is the virtual plane O side overlaps the circulating liquid chamber S in plan view. That is, the circulating communication path 72 communicates with the circulating liquid chamber S. As described above, each of the plurality of communication paths 63 communicates with the circulating liquid chamber S via circulating communication path 72. Therefore, as illustrated in arrows of broken lines of FIG. 6, the ink in each communication path 63 is supplied to the circulating liquid chamber S via circulating communication path 72. That is, in the first embodiment, the plurality of communication paths 63 corresponding to the first nozzle row L1 and the plurality of communication paths 63 corresponding to the second nozzle row L2 commonly communicate with respect to one circulating liquid chamber S.

As described above, the pressure chamber C of the embodiment indirectly communicates with the circulating liquid chamber S via the communication path 63 and the circulating communication path 72. According to the configuration, when a pressure in the pressure chamber C varies due to the operation of the piezoelectric element 44, a part of the ink flowing in the communication path 63 discharged from the nozzle N to the outside, and the remaining part thereof flows from the communication path 63 into the circulating liquid chamber S through the circulating communication path 72. In the embodiment, an inertance between the communication path 63, the nozzle, and the circulating communication path 72 is selected, so that an amount (hereinafter, referred to as "discharging amount") of the ink discharged via nozzle N in the ink circulating the communication path 63, for example, by driving of the piezoelectric element 44 one time is larger than an amount (hereinafter, referred to as "circulating amount") of the ink flowing into the circulating liquid chamber S via circulating communication path 72 in the ink circulating the communication path 63.

a circulation mechanism 75 illustrated in FIG. 5 is a mechanism for supplying (that is, circulating) the ink in the circulating liquid chamber S to the first circulation flow path R1 and the second circulation flow path R2. The circulation mechanism 75 includes, for example, a suction mechanism (for example, a pump) which sucks the ink from the circulating liquid chamber S, a filter mechanism which collects bubbles and foreign matters mixed in the ink, and a heating mechanism which reduces viscosity by heating the ink (not illustrated). The ink for which bubbles and foreign matters are removed and of which the viscosity is reduced by the circulation mechanism 75 is supplied from the circulation mechanism 75 to each of the first circulation flow path R1 and the second circulation flow path R2 via two connection ports 482. Therefore, on the first portion P1 side of the first embodiment, the ink circulates in paths of the first circulation flow path R1, the supply path 61, the pressure chamber C, the communication path 63, the circulating communication path 72, the circulating liquid chamber S, the circulation mechanism 75, and the first circulation flow path R1 in this order. In addition, on the second portion P2 side, the ink circulates in paths of the second circulation flow path R2, the supply path 61, the pressure chamber C, the communication path 63, the circulating communication path 72, the circulating liquid chamber S, the circulation mechanism 75, and the second circulation flow path R2 in this order.

The circulation mechanism 75 sucks the ink from both sides of the circulating liquid chamber S in the Y direction. The circulating liquid chamber S is formed of a circulation port Sta positioned in the vicinity of the positive side in the Y direction, and a circulation port Stb positioned in the vicinity of the end portion on the negative side in the Y direction. The circulation mechanism 75 sucks the ink from both the circulation port Sta and the circulation port Stb. Moreover, in a configuration in which the ink is sucked only from one end portion of the circulating liquid chamber S in the Y direction, a difference in the pressure of the ink between both end portions of the circulating liquid chamber S is generated, and the pressure of the ink in the communication path 63 may differ due to the difference in the pressure in the circulating liquid chamber S depending on the position in the Y direction. Therefore, there is a possibility that discharging characteristics (for example, the discharging amount and a discharging speed) of the ink from each nozzle N are different depending on the position in the Y direction. In contrast to the above configuration, in the first embodiment, since the ink is sucked from the both sides (circulation port Sta and circulation port Stb) of the circulating liquid chamber S, the difference in the pressure inside the circulating liquid chamber S is reduced. Therefore, it is possible to approximate the discharging characteristics of the ink with high accuracy over the plurality of nozzles N arranged in the Y direction. However, in a case where the difference in the pressure in the Y direction in the circulating liquid chamber S does not cause a particular problem, the ink may be sucked from one end portion of the circulating liquid chamber S.

In addition, since the circulating communication path 72 and the communication path 63 overlap in plan view, and the communication path 63 and the pressure chamber C overlap in plan view, the circulating communication path 72 and the pressure chamber C overlap each other in plan view. On the other hand, the circulating liquid chamber S and the pressure chamber C do not overlap each other in plan view. In addition, since the piezoelectric element 44 is formed over an entirety of the pressure chamber C along the X direction, the circulating communication path 72 and the piezoelectric element 44 overlap each other in plan view, and the circulating liquid chamber S and the piezoelectric element 44 do not overlap each other in plan view. According to the configuration, since the pressure chamber C or the piezoelectric element 44 overlaps the circulating communication path 72 in plan view, but does not overlap the circulating liquid chamber S in plan view, for example, the liquid discharging head 26 is easily reduced in size compared to a case where the pressure chamber C or the piezoelectric element 44 does not overlap the circulating communication path 72 in plan view. Of course, the pressure chamber C and the piezoelectric element 44 may overlap the circulating liquid chamber S in plan view.

In addition, since the circulating communication path 72 the communication path 63 and the circulating liquid chamber S for communicating the communication path 63 and the circulating liquid chamber S is formed in the nozzle plate 52, it is possible to efficiently circulate the ink in the vicinity of the nozzle N to the circulating liquid chamber S compared to a case where the circulating communication path is formed in the communication plate 32. In addition, in the first embodiment, the communication path 63 corresponding to the first nozzle row L1 and the communication path 63 corresponding to the second nozzle row L2 commonly communicate with the circulating liquid chamber S between both sides. Therefore, it is possible to simplify the configuration of the liquid discharging head 26, so that the liquid discharging head 26 can be reduced in size compared to a configuration in which the circulating liquid chamber S communicating with each of the circulating communication paths 72 corresponding to the first nozzle row L1 and the circulating liquid chamber S communicating with each of the circulating communication paths 72 corresponding to the second nozzle row L2 are individually provided.

Wiring Substrate

The wiring substrate 45 illustrated in FIG. 3 is constituted of a protection substrate 46 and a driving IC 47 stacked on the first flow path member 30. The wiring substrate 45 of the embodiment illustrates a case where the driving IC 47 is installed on the protection substrate 46 and wiring between the driving IC 47 and the piezoelectric element 44 is provided in the protection substrate 46. The protection substrate 46 is a plate-like member for protecting a plurality of piezoelectric elements 44. The protection substrate 46 of the embodiment is installed on a surface Fc of the vibrating portion 42. Moreover, the protection substrate 46 may be installed on the surface of the pressure chamber substrate 34. The surface of the second flow path member 48 on the positive side in the Z direction is formed of a groove-like recess portion 484 extending in the Y direction, and the pressure chamber substrate 34, the vibrating portion 42, and the wiring substrate 45 are accommodated in the recess portion 484. The first flow path member 30 and the second flow path member 48 are stacked so that the recess portion 484 overlaps the first region A in plan view. Therefore, an opening of the recess portion 484 on the negative side in the Z direction is closed by the first flow path member 30. The recess portion 484 may be open to the atmosphere. Therefore, the recess portion 484 of the embodiment functions as an accommodation space G for accommodating the wiring substrate 45. As described above, the accommodation space G is formed so as to overlap the first region A in plan view between the first flow path member 30 and the second flow path member 48.

Although a material and a manufacturing method of the protection substrate 46 are arbitrary, similar to the communication plate 32 and the pressure chamber substrate 34, it is possible to form the protection substrate 46 by processing a single crystal substrate of Si, for example, using the semiconductor manufacturing technique. The plurality of piezoelectric elements 44 are accommodated in the recess portion formed on the surface of the protection substrate 46 on the vibrating portion 42 side. A space surrounded by the recess portion of the protection substrate 46 and the vibrating portion 42 constitutes an installation space 462 of the piezoelectric element 44. The protection substrate 46 can protect the piezoelectric element 44 from moisture, impact from the outside, or the like by sealing the installation space 462 of the piezoelectric element 44.

The driving IC 47 is mounted on the surface (mounting surface) of the protection substrate 46 on a side opposite to the vibrating portion 42 side. The driving IC 47 is a substantially rectangular IC chip including a driving circuit for driving the plurality of piezoelectric elements 44. The driving IC 47 generates and supplies the driving signal of the piezoelectric element 44 under the control by the control unit 20 to drive each of the piezoelectric elements 44. At least a part of the piezoelectric elements 44 of the liquid discharging head 26 overlap the driving IC 47 in plan view. As illustrated in FIG. 4, the protection substrate 46 of the embodiment is provided with a plurality of connection terminals 464 and wirings 466 for electrically connecting the driving IC 47 and each of the piezoelectric elements 44.

Wiring Structure for Driving Piezoelectric Element

Figure 7:
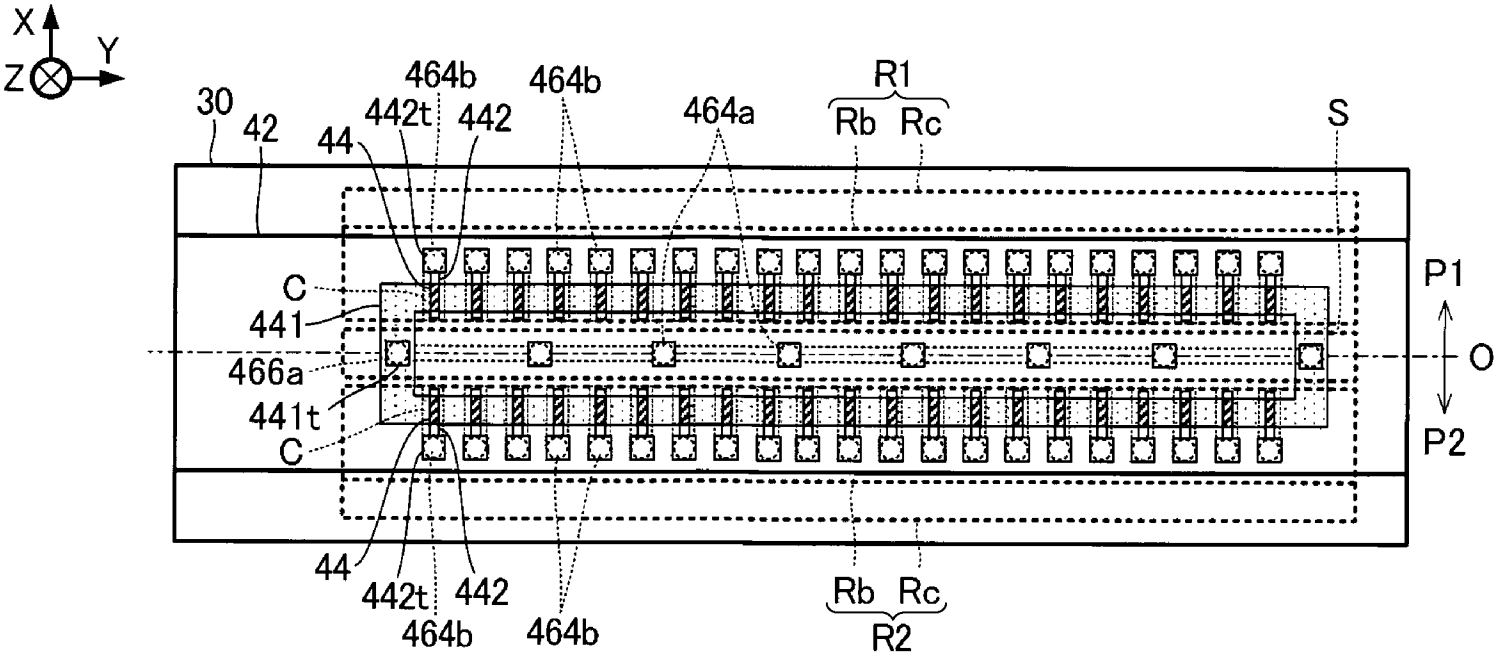
FIG. 7 is a plan view of a vibrating portion and a piezoelectric element illustrated in FIG. 3 as viewed from above.
Figure 8:
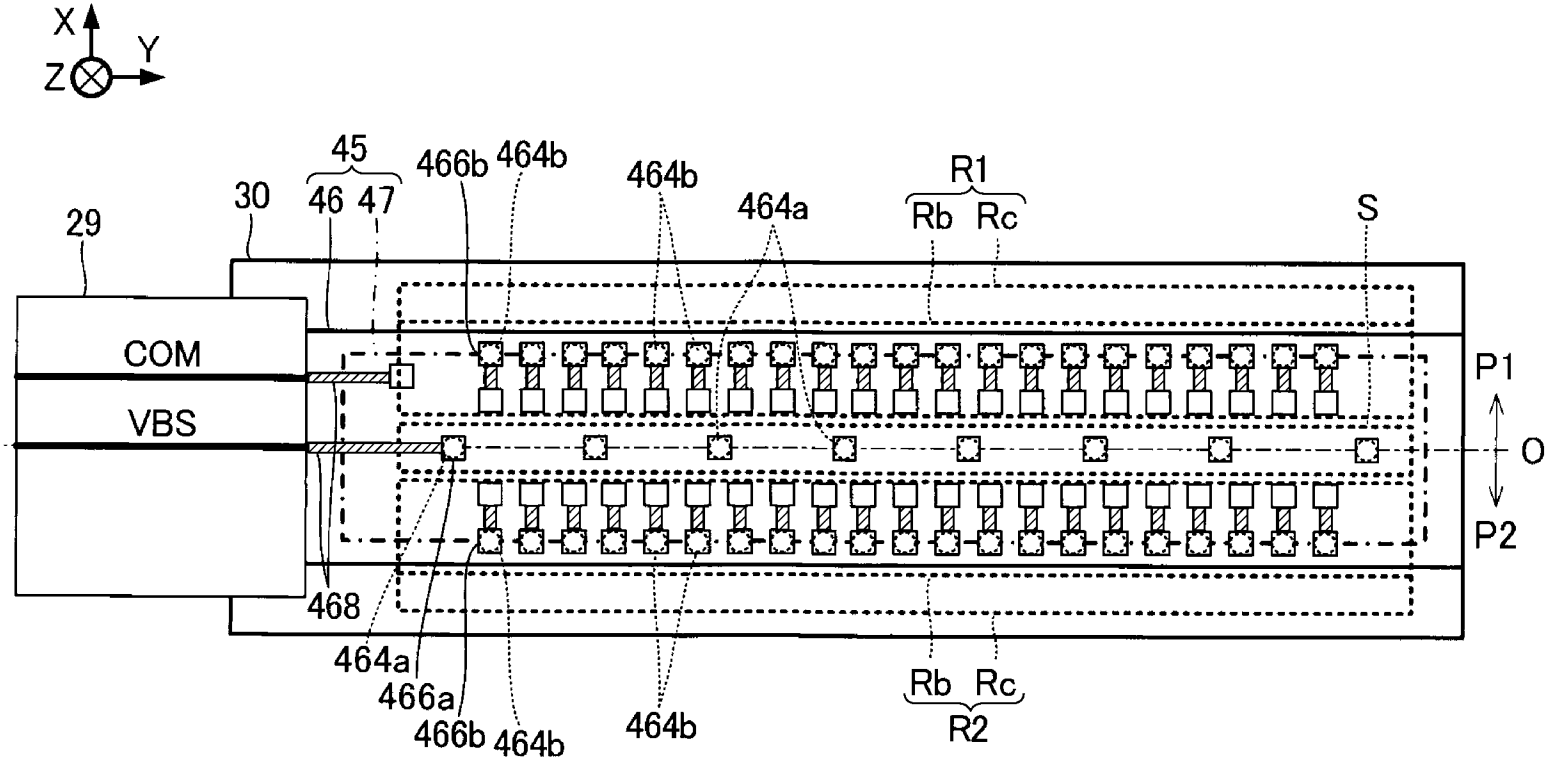
FIG. 8 is a plan view of a protection member illustrated in FIG. 3 as viewed from above.

Here, a wiring structure of the liquid discharging head 26 for driving the piezoelectric element 44 will be described. FIGS. 7 and 8 are explanatory views of the wiring structure for driving the piezoelectric element 44 of the embodiment. FIG. 7 is a plan view of the vibrating portion 42 and the piezoelectric element 44 as viewed in the Z direction (from above). FIG. 8 is a plan view of the protection substrate 46 as viewed in the Z direction (from above). In the embodiment, a first piezoelectric element and a second piezoelectric element are provided. In FIG. 7, the plurality of piezoelectric elements 44 arranged on one side (for example, the first portion P1 side) in the X direction as viewed from the virtual plane O correspond to the first piezoelectric element and the plurality of piezoelectric elements 44 arranged on the other side (for example, the second portion P2 side) in the X direction as viewed from the virtual plane O correspond to the second piezoelectric element.

As illustrated in FIGS. 3 and 8, the wiring 466 formed in the protection substrate 46 is divided into a first wiring 466*a* and a second wiring 466*b*. The connection terminal 464 is divided into a first connection terminal 464*a* electrically connected to the first wiring 466*a* and a second connection terminal 464*b* electrically connected to the second wiring 466*b*. The first wiring 466*a* is wiring connected to an output terminal of a base voltage VBS of the driving IC 47 and is formed continuously in the Y direction along the arrangement of the piezoelectric elements 44. Specifically, the first wiring 466*a* includes a plurality of penetrating wirings formed by burying a metal in a through-hole penetrating the protection substrate 46 in the Z direction, and a connection wiring which extends in the Y direction in the protection substrate 46 and is connected to the plurality of penetrating wirings. Moreover, the first wiring 466*a* is not limited to the configuration of the penetrating wirings and the connection wiring.

The second wiring 466*b* is wiring connected to an output terminal of a driving voltage COM (driving signal) of the driving IC 47, and is formed corresponding one by one to each of the plurality of piezoelectric elements 44. Specifically, a plurality of second wirings 466*b* corresponding to the plurality of piezoelectric elements 44 constituting the first piezoelectric element, and a plurality of second wirings 466*b* corresponding to the plurality of piezoelectric elements 44 constituting the second piezoelectric element are respectively arranged in the Y direction. Each of the second wirings 466*b* is formed of a penetrating wiring formed by burying a metal in the through-hole penetrating the protection substrate 46 in the Z direction, and a connection wiring extending in the X direction of the protection substrate 46 and connected to a terminal (not illustrated) of the driving IC 47 for driving the penetrating wiring. Moreover, the second wiring 466*b* is not limited to the configuration of the penetrating wiring and the connection wiring.

The first connection terminal 464*a* connects a terminal 441*t* of the first electrode 441 that is a common electrode of each of the piezoelectric elements 44 and the first wiring 466*a*. Therefore, the first electrode 441 of each of the piezoelectric elements 44 is connected to the output terminal of the base voltage VBS of the driving IC 47 via first connection terminal 464*a* and the first wiring 466*a*. Therefore, the base voltage VBS output from the output terminal of the driving IC 47 is applied to the first electrode 441 of each of the piezoelectric elements 44 via first wiring 466*a* and the first connection terminal 464*a*.

The second connection terminal 464*b* connects a terminal 442*t* of the second electrode 442 that is an individual electrode of each of the piezoelectric elements 44 and the second wiring 466*b*. Therefore, the second electrode 442 of each of the piezoelectric elements 44 is connected to the output terminal of the driving voltage COM of the driving IC 47 via second connection terminal 464*b* and the second wiring 466*b*. Therefore, the driving voltage COM output from the output terminal of the driving IC 47 is applied to the second electrode 442 of each of the piezoelectric elements 44 via second connection terminal 464*b* and the second wiring 466*b*.

As illustrated in FIG. 3, each of the first connection terminal 464*a* and the second connection terminal 464*b* is formed of, for example, a resin core bump in which a protrusion made of a resin material is covered with a conductive material. However, each of the first connection terminal 464*a* and the second connection terminal 464*b* is not limited to the resin core bump, and for example, may be constituted of a metal bump. Moreover, similar to the first connection terminal 464*a* and each second connection terminal 464*b*, a resin core bump is connected between the terminal of the driving IC 47 and the first wiring 466*a*, and between the terminal of the driving IC 47 and each second wiring 466*b*, or the metal bump may be connected therebetween.

As illustrated in FIGS. 7 and 8, the terminal 442*t* of the second electrode 442 of any one of the piezoelectric elements 44 among the plurality of piezoelectric elements 44 constituting the first piezoelectric element is connected to one of the second connection terminals 464*b* of the plurality of connection terminals 464 on the first portion P1 side corresponding to any one of the piezoelectric elements 44. The terminal 442*t* of the second electrode 442 of any one of the piezoelectric elements 44 among the plurality of piezoelectric elements 44 constituting the second piezoelectric element is connected to one of the second connection terminals 464*b* of the plurality of connection terminals 464 on the second portion P2 side corresponding to any one of the piezoelectric elements 44. In addition, any one of the terminals 441*t* of the terminals 441*t* of the first electrode 441 is connected to one of the first connection terminals 464*a* corresponding to any one of the terminals 441*t*. Moreover, the number of the first connection terminals 464*a* is smaller than the number of the second connection terminals 464*b*. The number of the first connection terminals 464*a* may be one, but it is possible to stabilize the base voltage VBS of each of the piezoelectric elements 44 arranged in the Y direction by arranging a plurality of first connection terminals 464*a* in the Y direction.

As illustrated in FIG. 2, the protection substrate 46 is formed of a plurality of wirings 468 including wirings of the driving voltage COM and the base voltage VBS connected to an input terminal of the driving IC 47. The plurality of wirings 468 extend to a region E positioned at an end portion of a mounting surface of the protection substrate 46 in the Y direction (that is, in a direction in which the plurality of piezoelectric elements 44 are arranged). The region E is connected to a wiring member 29. The wiring member 29 is a mounting component in which a plurality of wirings (not illustrated) electrically connecting the control unit 20 and the driving IC 47 is formed. For example, a flexible substrate such as a Flexible Printed Circuit (FPC) or a Flexible Flat Cable (FFC) is suitably adopted as the wiring member 29. As described above, the protection substrate 46 of the embodiment also functions as a substrate in which the wirings 466 and 468 for transmitting driving signals are formed. However, it is also possible to dispose the substrate used for mounting of the driving IC 47 and forming the wiring, separately from the protection substrate 46.

Figure 9:
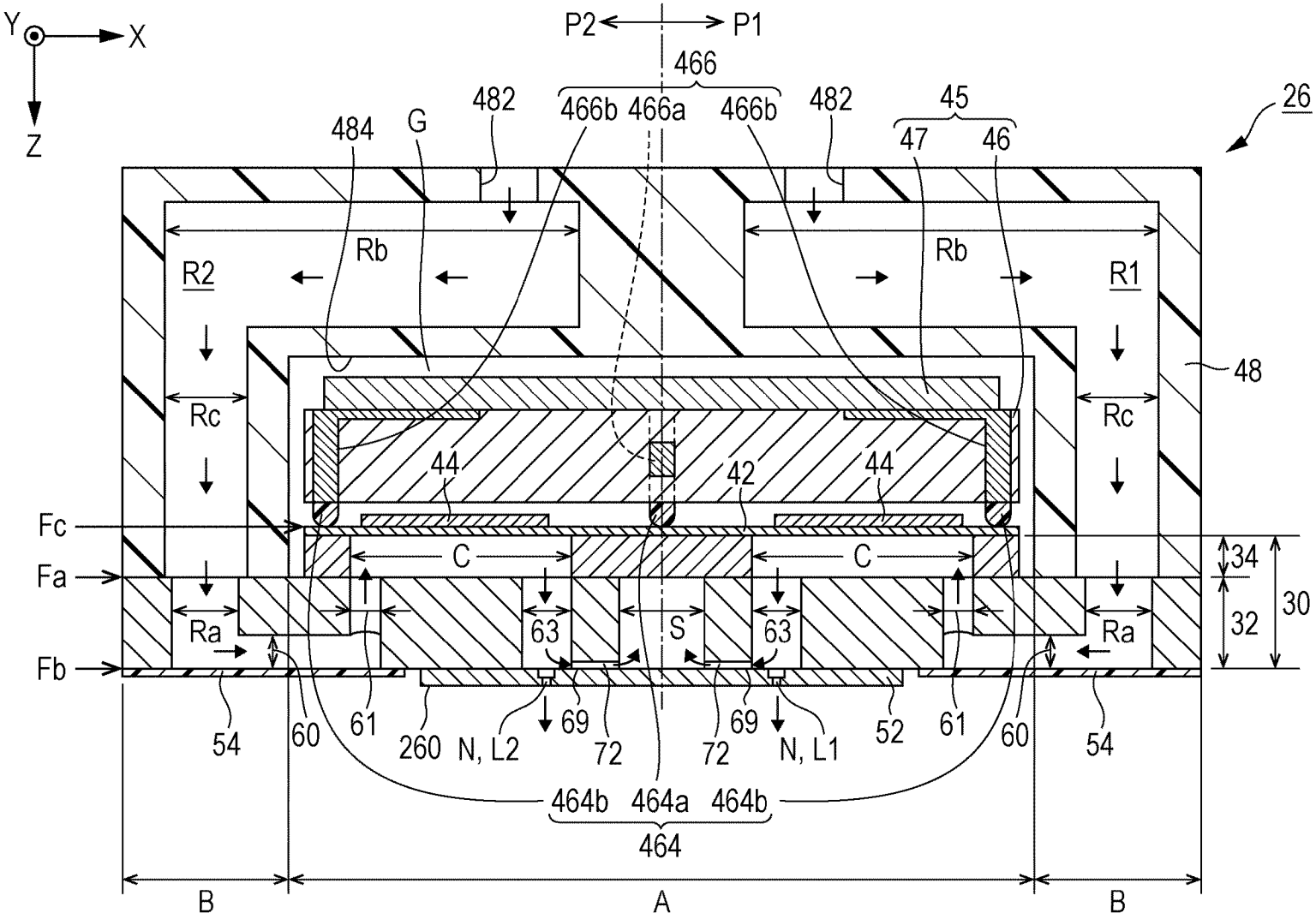
FIG. 9 is a view for explaining an operation of the liquid discharging head.

FIG. 9 is an explanatory view for explaining a flow of the ink in the liquid discharging head 26 of the first embodiment. FIG. 9 is a sectional view of the liquid discharging head 26 and corresponds to FIG. 3. According to the liquid discharging head 26 of the first embodiment, it is possible to form the flow of the ink circulating as illustrated in arrows of FIG. 9. Specifically, on the first portion P1 side, it is possible to form the flow of the ink circulating in paths of the first circulation flow path R1, the supply path 61, the pressure chamber C, the communication path 63, the circulating communication path 72, the circulating liquid chamber S, the circulation mechanism 75, and the first circulation flow path R1 in this order. On the second portion P2 side, it is possible to form the flow of the ink circulating in paths of the second circulation flow path R2, the supply path 61, the pressure chamber C, the communication path 63, the circulating communication path 72, the circulating liquid chamber S, the circulation mechanism 75, and the second circulation flow path R2 in this order.

In the liquid discharging head 26 of the first embodiment, an inertance between the communication path 63, the nozzle N, and the circulating communication path 72 is selected, so that the discharging amount of the ink discharged via nozzle N in the ink circulating the communication path 63 by driving of the piezoelectric element 44 one time is larger than the circulating amount of the ink flowing into the circulating liquid chamber S via circulating communication path 72 in the ink circulating the communication path 63.

Specifically, for example, a flow path resistance of each of the communication path 63, the nozzle N, and the circulating communication path 72 is determined, so that a ratio of the circulating amount of the ink circulating the communication path 63 from the inside of the pressure chamber C becomes 70% or more (ratio of the discharging amount is 30% or less). According to the configuration described above, it is possible to effectively circulate the ink in the vicinity of the nozzle N to the circulating liquid chamber S while ensuring the discharging amount of the ink. Moreover, the ratio of the discharging amount and the circulating amount of the ink which is described above is not limited to 70%, and can be adjusted by the flow path resistance of the circulating communication path 72. As the flow path resistance of the circulating communication path 72 increases, the circulating amount can be decreased and the discharging amount can be increased, and as the flow path resistance of the circulating communication path 72 decreases, the circulating amount can be increased and the discharging amount can be decreased.

As described above, in the liquid discharging head 26 having the configuration of the first embodiment, the second flow path member 48 is stacked on the first flow path member 30 so as to overlap each other in the Z direction. As illustrated in FIG. 3, the surface of the first flow path member 30 includes the first region A which is stacked on the second flow path member 48 via wiring substrate 45 and the second region B which is stacked on the second flow path member 48 without the wiring substrate 45. The surface of the first flow path member 30 is the surface of the first flow path member 30 on the negative side in the Z direction. A region where the pressure chamber substrate 34 and the vibrating portion 42 are stacked on the communication plate 32, and a region where they are not stacked are provided on the surface of the first flow path member 30 of the embodiment on the negative side in the Z direction. Therefore, the surface of the first flow path member 30 of the embodiment is the surface Fa of the communication plate 32 in the region where the pressure chamber substrate 34 and the vibrating portion 42 are not stacked on the communication plate 32, and is the surface Fc (portion of the surface of the pressure chamber substrate 34, where the vibrating portion 42 is not stacked, also includes the surface of the pressure chamber substrate 34 of the portion) of the vibrating portion 42 in the region where the pressure chamber substrate 34 and the vibrating portion 42 are stacked on the communication plate 32.

As illustrated in FIG. 3, the first region A of the embodiment is a region overlapping the accommodation space G in plan view and includes not only the surface Fc of the vibrating portion 42 but also a part of the surface Fa of the communication plate 32. As described above, the first region A may include a part of the surface Fa of the communication plate 32. The second region B of the embodiment includes the surface Fa of the communication plate 32 and does not include the surface Fc of the vibrating portion 42. Moreover, the surface of the first flow path member 30 illustrated in FIG. 3 includes the first region A extending over the first portion P1 and the second portion P2, and the second region B of each of the first portion P1 and the second portion P2.

Surface of the second flow path member 48 is joined to the surface (second region B of the surface Fa of the communication plate 32 in the first embodiment) of the first flow path member 30, for example, for example, by adhesive or the like so as to overlap the first region A and the second region B in the Z direction. The wiring substrate 45 is disposed in the accommodation space G formed in the first flow path member 30 in the first region A. The space Ra serving as the first flow path formed in the first flow path member 30 in the second region B of the first portion P1 and the space Rc serving as the second flow path formed in the second flow path member 48 communicate with each other, and thereby the first circulation flow path R1 is formed. The space Ra serving as the first flow path formed in the first flow path member 30 in the second region B of the second portion P2 and the space Rc serving as the second flow path formed in the second flow path member 48 communicate with each other, and thereby the second circulation flow path R2 is formed. Moreover, since the first region A and the second region B are arranged in a direction along an in-plane direction of the X-Y plane, the wiring substrate of the first region A and the circulation flow paths R1 and R2 of the second region B can be arranged so as to overlap in the direction along the in-plane direction of the X-Y plane.

As described above, in the embodiment, the wiring substrate 45 is disposed in the first region A and the first circulation flow path R1 and the second circulation flow path R2 are disposed in the second region B. Therefore, the wiring substrate 45 is not interposed in the second region B in which the first circulation flow path R1 and the second circulation flow path R2 are formed. According to the configuration, the adhesive layer such as the photosensitive resin layer for joining the wiring substrate 45 cannot be exposed to the first circulation flow path R1 and the second circulation flow path R2. Therefore, the contact of the ink circulating the first circulation flow path R1 and the ink circulating the second circulation flow path R2 with the adhesive layer of the wiring substrate 45 can be avoided, so that it is possible to suppress an decreased in a mechanical strength of the liquid discharging head 26 due to the contact between the adhesive layer of the wiring substrate 45 and the ink. As described above, according to the embodiment, it is possible to suppress the decreased in the mechanical strength of the liquid discharging head 26 caused by the disposition of the wiring substrate 45 and the circulation flow path.

Moreover, in the embodiment, it is also possible to use photosensitive resin as the adhesive for joining the first flow path member 30 and the second flow path member 48. In this case, in a case where the first flow path member 30 and the second flow path member 48 are joined by the adhesive in the second region B of the first portion P1 and the second region B of the second portion P2, the photosensitive resin is exposed to the first circulation flow path R1 and the second circulation flow path R2 as the adhesive layer. Also, in this case, in the embodiment, since there is no photosensitive resin layer for joining the wiring substrate 45, it is possible to reduce the adhesive layer exposing to the first circulation flow path R1 and the second circulation flow path R2. In addition, the photosensitive resin for joining the first flow path member 30 and the second flow path member 48 can be extremely thinned compared to a case where the accommodation space G of the wiring substrate 45 is formed in the photosensitive resin layer that is the adhesive layer of the wiring substrate 45. Therefore, even if the first flow path member 30, the second flow path member 48, and the adhesive layer come into contact with the ink, there is almost no influence, and the mechanical strength of the liquid discharging head 26 can be maintained.

In addition, in the present specification, the expression "element a and element b are stacked" is not limited to a configuration in which the element a and the element b are in direct contact with each other. That is, a configuration in which another element c is interposed between the element a and the element b is also included in the concept that "element a and element b are stacked". Therefore, a single body of the Si layer, a stacked layer body of a plurality of layers including the Si layer, or the like may be interposed between the first flow path member 30 and the second flow path member 48. Examples of the stacked layer body of the plurality of layers including the Si layer include a stacked layer body of a Si layer and a SiO2 layer, a stacked layer body of a Si layer, a SiO2 layer, and a ZrO2 layer, and the like. The single body of the Si layer and the stacked layer body of the plurality of layers including the Si layer may be constituted as the vibrating portion 42. That is, the vibrating portion 42 of the embodiment may be constituted so as to extend to a space between the first flow path member 30 and the second flow path member 48 in the second region B.

Meanwhile, a current flows through the wiring 466 and the connection terminal 464 of the protection substrate 46 by driving of the piezoelectric element 44, so that the wiring 466 and the connection terminal 464 generate heat, and the driving IC 47 also generates heat. As in the embodiment, as the wiring substrate 45 (protection substrate 46 and driving IC 47) is disposed near the piezoelectric element 44, the heat is transmitted via wiring 466 and the connection terminal 464, and heat tends to accumulate in the accommodation space G surrounding the wiring substrate 45. As described above, if the heat is accumulated in the accommodation space G, characteristics of the piezoelectric element 44 change due to the influence of the heat, and there is a concern that the discharging characteristics change. In addition, the driving IC 47 is erroneously operated by the temperature rise due to the generation of the heat by the driving IC 47.

In this regard, in the first embodiment, the first circulation flow path R1 and the second circulation flow path R2 are disposed so as to be separated from each other in the X direction (example of the second direction), and the wiring substrate 45 is disposed between the first circulation flow path R1 and the second circulation flow path R2 in the X direction. According to the configuration, since the circulation flow paths are disposed on both sides of the wiring substrate 45 in the second direction, the wiring substrate 45 can be cooled by radiating the heat to the ink flowing through the circulation flow paths on the both sides of the wiring substrate 45. Therefore, a cooling effect of the wiring substrate 45 can be improved compared to a case where the circulation flow path is disposed only on one side of the wiring substrate 45 in the second direction. In addition, since the circulation flow paths are disposed on the both sides of the wiring substrate 45 in the X direction, a cooling gradient in the X direction can be reduced compared to a case where the circulation flow path is disposed only on one side of the wiring substrate 45 in the X direction.

In addition, as illustrated in FIG. 7, the first circulation flow path R1 and the second circulation flow path R2 of the embodiment are continuous in the Y direction over the plurality of pressure chambers C arranged in the Y direction on the first portion P1 side and the plurality of pressure chambers C arranged in the Y direction on the second portion P2 side. One pressure chamber C on the first portion P1 side and one pressure chamber C on the second portion P2 side are respectively disposed between the first circulation flow path R1 and the second circulation flow path R2 in the X direction. Therefore, the circulation of the ink is easily generated in the flow path through which the ink flows in the X direction via first circulation flow path R1 and the second circulation flow path R2 in the pressure chamber C on the first portion P1 side and the pressure chamber C on the second portion P2 side. Therefore, for example, it is possible to reduce a pressure gradient for each of the pressure chambers C arranged in the Y direction compared to a case where the circulation of the ink in the flow path through which the ink flows in the Y direction rather than the X direction is easily generated in the circulation flow path, for example, as in a case where the circulation flow path is disposed in the Y direction so as to sandwich the plurality of pressure chambers C arranged in the Y direction, or the like. In addition, since the first circulation flow path R1 and the second circulation flow path R2 extend in the Y direction, heat of the accommodation space G and the wiring substrate 45 extending in the Y direction therebetween can be evenly radiated in the Y direction. Therefore, the cooling gradient of the accommodation space G and the wiring substrate 45 in the Y direction can be reduced.

In addition, the base voltage VBS that is a common voltage is applied to the common electrode of the piezoelectric element 44 of the embodiment, and the driving voltage COM that is an individual voltage is applied to the individual electrode, so that the second connection terminal 464*b* connected to the individual electrode more likely to generate than the first connection terminal 464*a* connected to the common electrode. In this regard, in the embodiment, the first circulation flow path R1 is disposed at a position closer to the second connection terminal 464*b* which is more likely to generate heat than to the first connection terminal 464*a* in the X direction of the first portion P1. In addition, the second circulation flow path R2 rather than the first connection terminal 464*a* is disposed at a position closer to the second connection terminal 464*b* which is more likely to generate heat in the X direction of the second portion P2. Therefore, it is possible to improve the cooling efficiency of the second connection terminal 464*b* of the first portion P1 and the second connection terminal 464*b* of the second portion P2. Moreover, one of the first circulation flow path R1 and the second circulation flow path R2 may be disposed at a position closer to the second connection terminal 464*b* than to the first connection terminal 464*a*.

Here, for each of the first circulation flow path R1 and the second circulation flow path R2 illustrated in FIG. 3, the space Rc is referred to as the first flow path extending in the Z direction and the space Rb is referred to as the second flow path extending in the X direction. Then, as illustrated in FIG. 7, the second flow path of the first circulation flow path R1 overlaps the second connection terminal 464*b* of the first portion P1 as viewed in the Z direction, and the second flow path of the second circulation flow path R2 overlaps the second connection terminal 464*b* of the second portion P2 as viewed in the Z direction. According to such a configuration, the heat from the second connection terminal 464*b* of the first portion P1 can be released not only to the first flow path but also to the second flow path of the first circulation flow path R1, and the heat from the second connection terminal 464*b* of the second portion P2 can be released not only to the first flow path but also to the second flow path of the second circulation flow path R2. Therefore, it is possible to improve the cooling efficiency of the wiring substrate 45 compared to a case where the heat from the second connection terminal 464*b* is released only to the first flow path. Moreover, one of the second flow path of the first circulation flow path R1 and the second flow path of the second circulation flow path R2 may overlap the second connection terminal 464*b* of the first portion P1 or the second connection terminal 464*b* of the second portion P2 as viewed in the Z direction.

Second Embodiment

Figure 10:
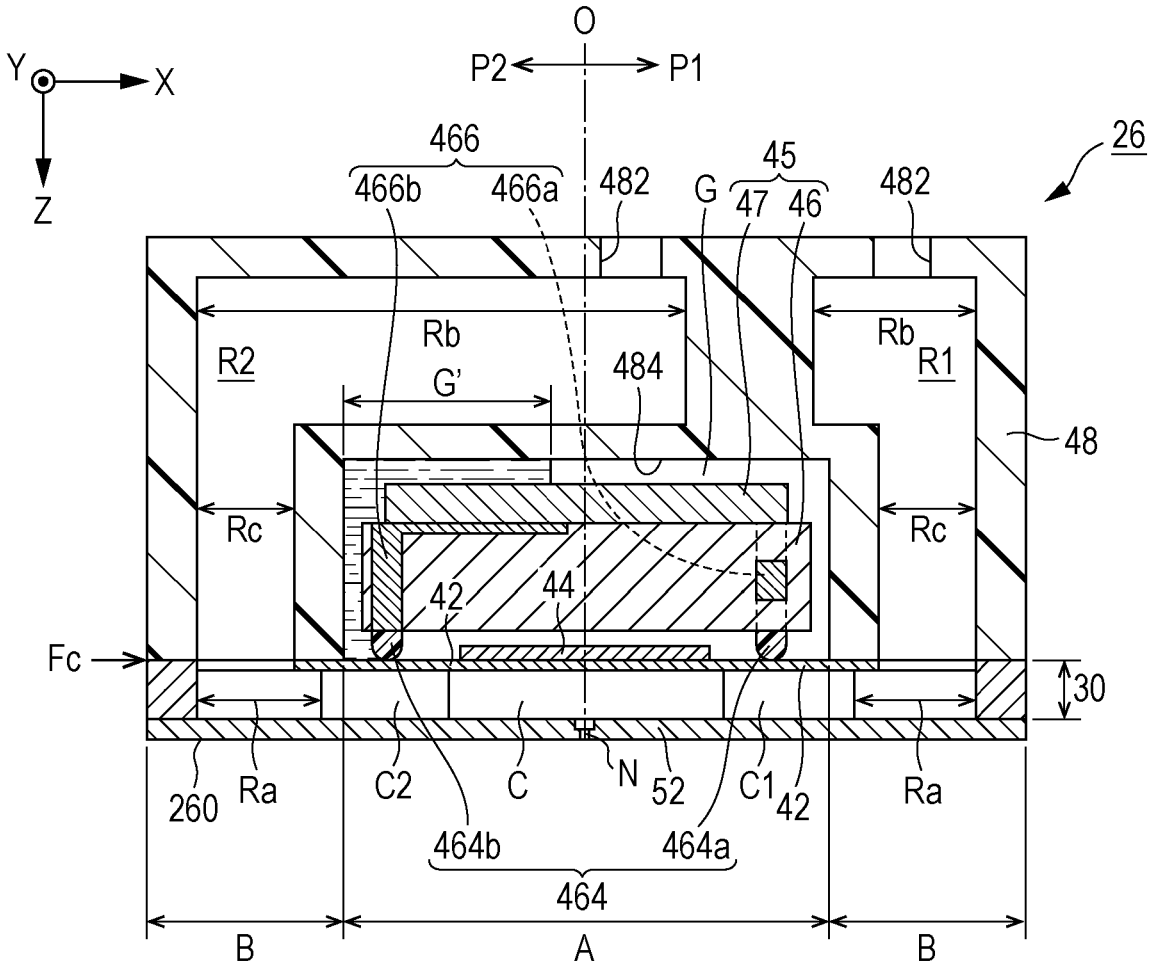
FIG. 10 is a sectional view illustrating a configuration of a liquid discharging head according to a second embodiment.
Figure 11:
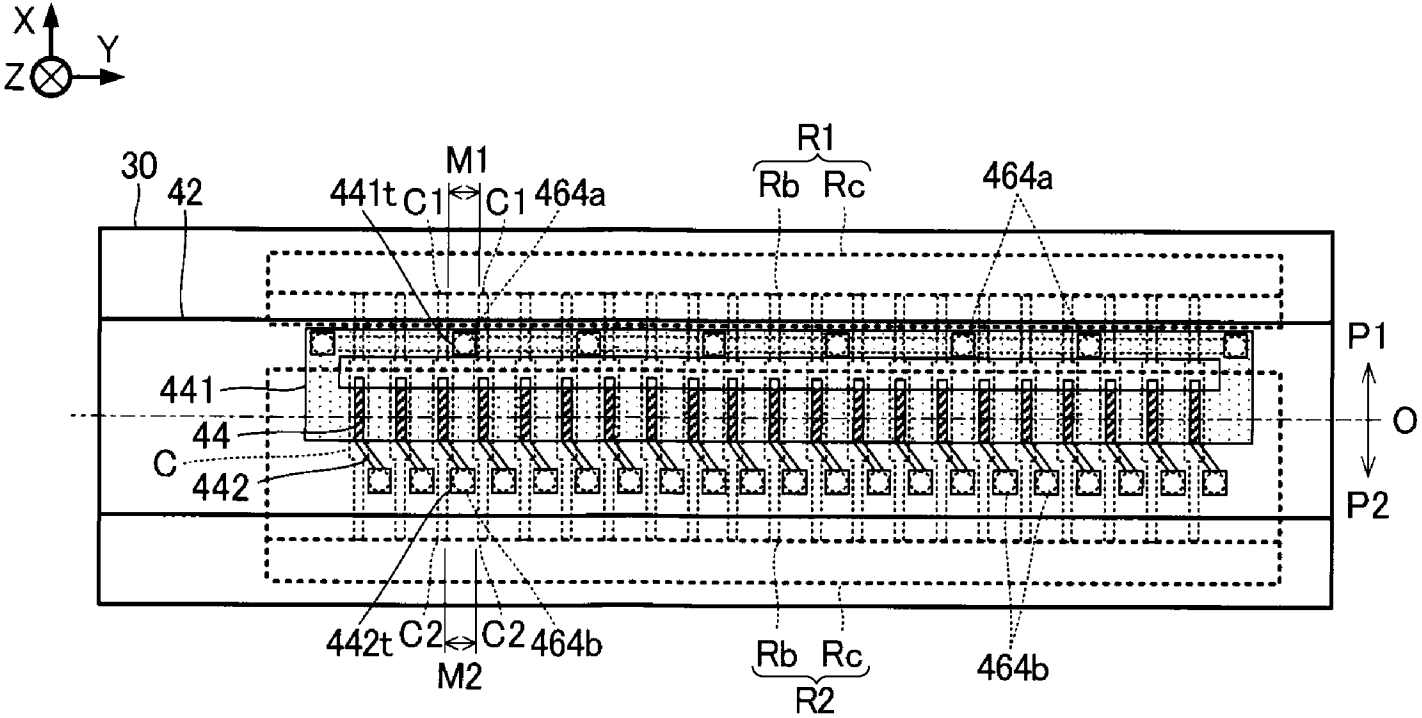
FIG. 11 is a plan view of a vibrating portion and a piezoelectric element illustrated in FIG. 10 as viewed from above.
Figure 12:
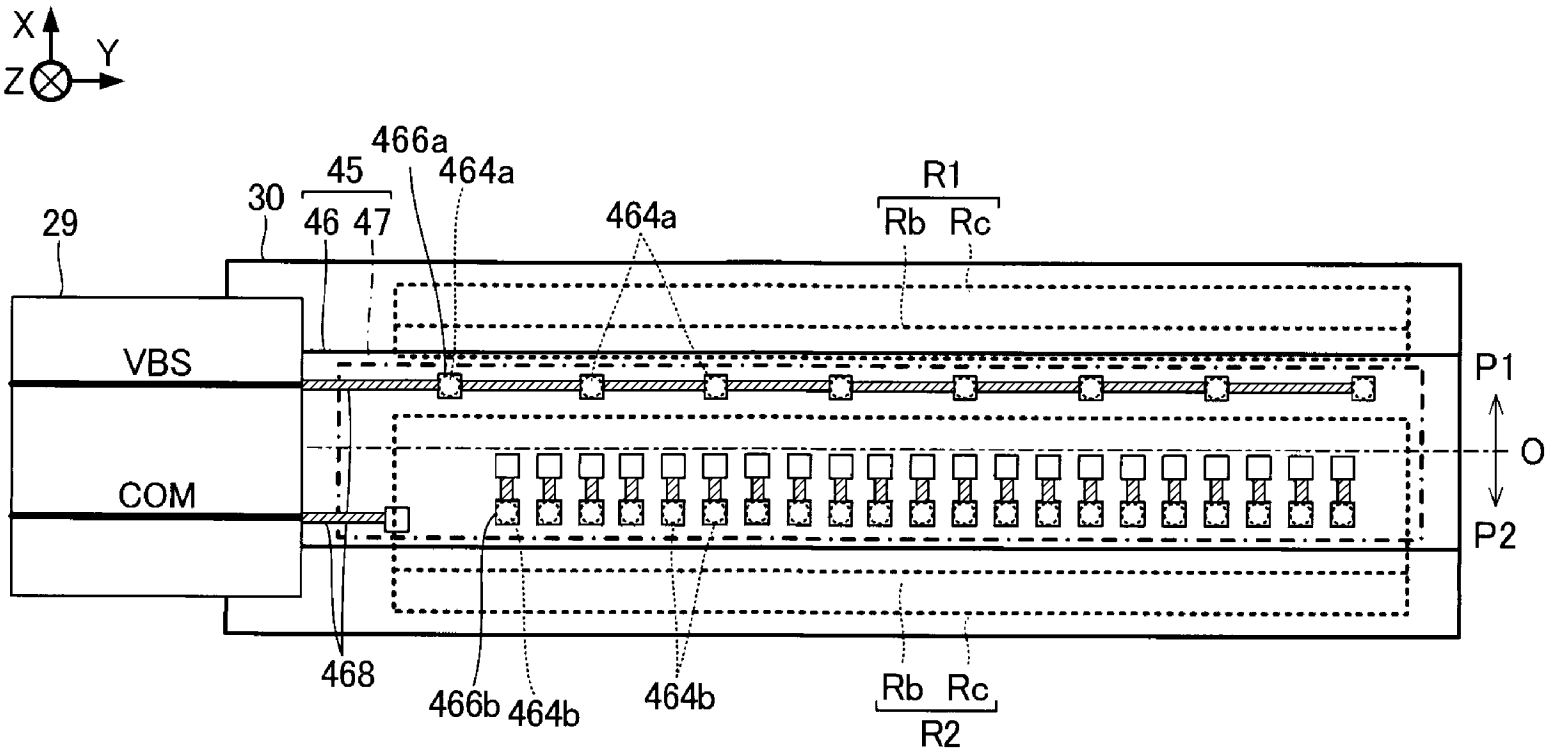
FIG. 12 is a plan view of a protection member illustrated in FIG. 10 as viewed from above.

A second embodiment of the invention will be described. With respect to elements in the following examples having the same operations and functions as those of the first embodiment, the reference numerals used in the description of the first embodiment are used, and the detailed description thereof is appropriately omitted. FIG. 10 is a sectional view illustrating a configuration of a liquid discharging head 26 according to the second embodiment and corresponds to FIG. 3. FIGS. 11 and 12 are explanatory views of a wiring structure for driving a piezoelectric element 44 of the second embodiment. FIG. 11 is a plan view of a vibrating portion 42 and the piezoelectric element 44 of the second embodiment as viewed in the Z direction (from above and corresponds to 7. FIG. 12 is a plan view of a protection substrate 46 as viewed in the Z direction (from above) and corresponds to FIG. 8.

In FIG. 3, a configuration, in which both the first circulation flow path R1 and the second circulation flow path R2 function as the circulation flow path on the flow-in side for supplying the ink to the pressure chamber C, is exemplified. In FIG. 10, a configuration, in which the first circulation flow path R1 functions as the circulation flow path on the flow-in side for supplying the ink to the pressure chamber C, and the second circulation flow path R2 functions as the circulation flow path on the flow-out side from which the ink of the pressure chamber C flows out, is exemplified. Therefore, in the configuration of FIG. 10, since the second circulation flow path R2 also functions as the circulating liquid chamber S, the circulating liquid chamber S is not provided. In addition, a surface of the second flow path member 48 on a side opposite to the communication plate 32 is formed of a connection port 482 for supplying the ink supplied from the liquid container 14 to the first circulation flow path R1, and a connection port 482 for allowing the ink flowing out from the second circulation flow path R2 to flow out to the liquid container 14.

The first portion P1 and the second portion P2 illustrated in FIG. 10 have a flow path configuration corresponding to one nozzle N. In the liquid discharging head 26 of the second embodiment, configurations of a plurality of first portions P1 and second portions P2 similar to those of FIG. 10 are arranged in the Y direction. In the first portion P1 and the second portion P2 of FIG. 10, shapes of the first circulation flow path R1 and the second circulation flow path R2, and a wiring structure of the wiring substrate 45 are different.

As illustrated in FIGS. 10 to 12, the first circulation flow path R1 of the second embodiment is disposed in the first portion P1, and the second circulation flow path R2 is disposed in the second portion P2. Also in the second embodiment, for each of the first circulation flow path R1 and the second circulation flow path R2, a space Rc is referred to as the first flow path extending in the Z direction and a space Rb is referred to as the second flow path extending in the X direction. Each of the first flow path and the second flow path of the first circulation flow path R1 and the second circulation flow path R2 is formed in the second flow path member 48. In addition, in the second embodiment, the first flow path and the second flow path in the first circulation flow path R1 correspond to flow paths of the circulation flow path for supplying the ink to the pressure chamber C. The first flow path and the second flow path in the second circulation flow path R2 correspond to flow paths of the circulation flow path allowing the ink from to the pressure chamber C to flow out. Moreover, the flow path for supplying the ink to the pressure chamber C may include the connection port 482 communicating with the second flow path in the first circulation flow path R1. In addition, the flow path for allowing the ink from the pressure chamber C to flow out may include the connection port 482 communicating with the second flow path in the second circulation flow path R2.

In the second flow path constituted of the space Rb of the second embodiment, the second circulation flow path R2 is longer than the first circulation flow path R1 in the X direction. The second flow path of the second circulation flow path R2 of FIG. 10 extends from the negative side in the X direction to the positive side in the X direction over the virtual plane O. The first wiring 466*a* and the first connection terminal 464*a* of the second embodiment are disposed in the first portion P1, and the second wiring 466*b* and the second connection terminal 464*b* are disposed in the second portion P2. As described above, in the second embodiment, the second connection terminal 464*b* which is more likely to generate heat than the first connection terminal 464*a* is disposed at a position closer to the second circulation flow path R2 than to the first circulation flow path R1. Therefore, the heat from the second connection terminal 464*b* is more likely to be transmitted to the ink of the second circulation flow path R2 than the first circulation flow path R1, and thereby the second connection terminal 464*b* is cooled. In this case, even if the temperature of the ink of the second circulation flow path R2 rises due to the heat from the second connection terminal 464*b*, since the second circulation flow path R2 is the circulation flow path on the flow-out side allowing the ink of the pressure chamber C to flow out, it is possible to suppress that the ink of which the temperature rises flows in the pressure chamber C. Therefore, it is possible to prevent the influence of the temperature rise of the ink of the second circulation flow path R2 from affecting the ink of the pressure chamber C.

The second flow path of the second circulation flow path R2 constituted of the space Rb overlaps the second connection terminal 464*b* of the second portion P2 as viewed in the Z direction. According to such a configuration, the heat from the second connection terminal 464*b* is released not only to the first flow path of the second circulation flow path R2 constituted of the space Rc but also to the second flow path constituted of the space Rb. Therefore, the second connection terminal 464*b* is more likely to be cooled than a case where the heat from the second connection terminal 464*b* is released to only the first flow path of the second circulation flow path R2. Furthermore, since the second connection terminal 464*b* which is more likely to generate the heat than the first connection terminal 464*a* can be cooled, it is possible to improve the cooling efficiency of the wiring substrate 45.

As illustrated in FIG. 10, the first flow path member 30 of the second embodiment is constituted of the pressure chamber substrate 34 and the vibrating portion 42, and is not provided with the communication plate 32. In addition, the first flow path member 30 of the second embodiment exemplifies a case where the pressure chamber substrate 34 includes the vibrating portion 42 and is integrally formed. Therefore, the surface Fc of the second embodiment corresponds to the surface (including the surface of the vibrating portion 42) of the pressure chamber substrate 34 on the negative side in the Z direction. For example, as described above, for a region of a plate-like member having a predetermined plate thickness corresponding to the pressure chamber C, a part thereof in a plate thickness direction is selectively removed, so that the pressure chamber substrate 34 and the vibrating portion 42 can be integrally constituted. Moreover, the pressure chamber substrate 34 and the vibrating portion 42 may be separately constituted. A plurality of piezoelectric elements 44 corresponding to different nozzles N are disposed on the negative side in the Z direction of the vibrating portion 42.

As illustrated in FIGS. 10 and 11, the pressure chamber substrate 34 of the second embodiment is formed of the plurality of pressure chambers C arranged in the Y direction. In addition, as illustrated in FIG. 10, the pressure chamber substrate 34 is formed of the space Ra constituting a part of the first circulation flow path R1 and the space Ra constituting of a part of the second circulation flow path R2. Each of the pressure chambers C and the space Ra of the first circulation flow path R1 are connected to a first individual flow path C1 on the flow-in side. Each of the pressure chambers C and the space Ra of the second circulation flow path R2 are connected to a second individual flow path C2 on the flow-out side. The first individual flow path C1 and the second individual flow path C2 are formed in the pressure chamber substrate 34. The nozzle plate 52 of the second embodiment is joined to the surface of the pressure chamber substrate 34 on the positive side in the Z direction so as to close each pressure chamber C, each space Ra, each first individual flow path C1, and each second individual flow path C2. One pressure chamber C communicates with one nozzle N. A predetermined flow path resistance may be added to each first individual flow path C1 and each second individual flow path C2 as throttle flow paths with narrowed flow path widths.

Figure 13:
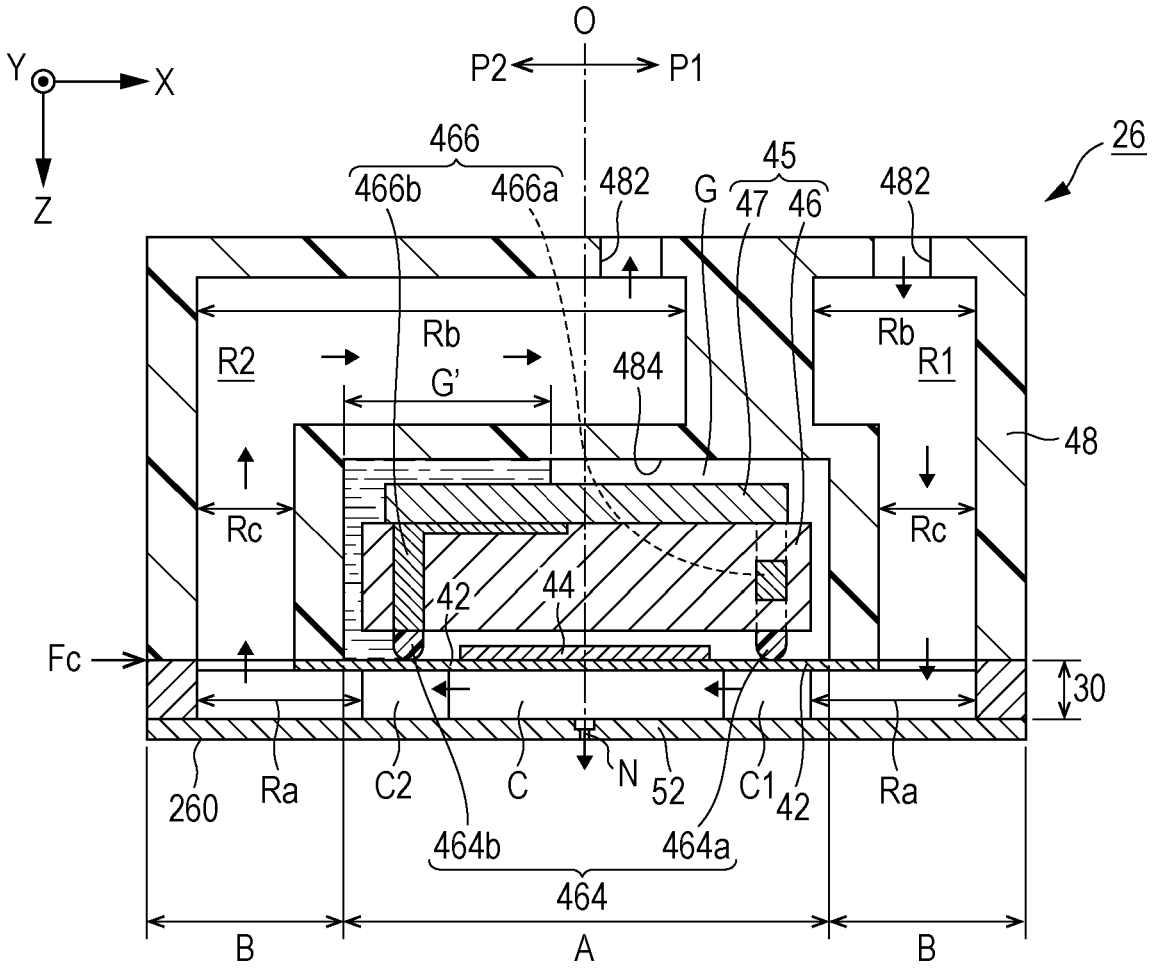
FIG. 13 is a view for explaining an operation of the liquid discharging head according to the second embodiment.

FIG. 13 is an explanatory view for explaining an operation of the flow of the ink in the liquid discharging head 26 according to the second embodiment. FIG. 13 is a sectional view of the liquid discharging head 26 and corresponds to FIG. 10. According to the liquid discharging head 26 of the second embodiment, it is possible to form the flow of the ink circulating as illustrated in arrows of FIG. 13. Specifically, on the first portion P1 side, it is possible to form the flow of the ink circulating in paths of the first circulation flow path R1, the first individual flow path C1, the pressure chamber C, the second individual flow path C2, and the second circulation flow path R2 in this order from the first portion P1 side to the second portion P2 side.

In the liquid discharging head 26 of the second embodiment, an inertance between the nozzle N and the second individual flow path C2 is selected, so that the discharging amount of the ink discharged via nozzle N in the ink circulating the pressure chamber C by driving of the piezoelectric element 44 one time is larger than the circulating amount of the ink flowing into the second circulation flow path R2 via second individual flow path C2 in the ink circulating the pressure chamber C.

In the liquid discharging head 26 having the configuration of the second embodiment, the second flow path member 48 is stacked on the first flow path member 30 so as to overlap each other in the Z direction. In the configuration of FIG. 10, the second flow path member 48 is joined to the surface Fc of the pressure chamber substrate 34 constituting the first flow path member 30 on the negative side in the Z direction. Also in the second embodiment, similar to the first embodiment, the surface of the first flow path member 30 includes the first region A stacked on the second flow path member 48 via wiring substrate 45, and the second region B stacked on the second flow path member 48 without the wiring substrate 45. The surface of the first flow path member 30 is a surface of the first flow path member 30 on the negative side in the Z direction. In the second embodiment, the surface Fc of the pressure chamber substrate 34 corresponds to the surface of the first flow path member 30. The surface (surface Fc of the pressure chamber substrate 34) of the first flow path member 30 illustrated in FIG. 10 includes the first region A extending over the first portion P1 and the second portion P2, and the second region B of each of the first portion P1 and the second portion P2.

Also in the second embodiment, similar to the first embodiment, the wiring substrate 45 is disposed in the first region A and the first circulation flow path R1 and the second circulation flow path R2 are disposed in the second region B. Therefore, the wiring substrate 45 is not interposed in the second region B in which the first circulation flow path R1 and the second circulation flow path R2 are formed. According to the configuration, the adhesive layer such as the photosensitive resin layer for joining the wiring substrate 45 cannot be exposed to the first circulation flow path R1 and the second circulation flow path R2. Therefore, the contact of the ink circulating the first circulation flow path R1 and the ink circulating the second circulation flow path R2 with the adhesive layer of the wiring substrate 45 can be avoided, so that it is possible to suppress a decrease in a mechanical strength of the liquid discharging head 26.

In addition, also in the second embodiment, similar to the first embodiment, a single body of the Si layer, a stacked layer body of a plurality of layers including the Si layer, or the like may be interposed between the first flow path member 30 and the second flow path member 48. Examples of the stacked layer body of the plurality of layers including the Si layer include a stacked layer body of a Si layer and a SiO2 layer, a stacked layer body of a Si layer, a SiO2 layer, and a ZrO2 layer, and the like. The single body of the Si layer and the stacked layer body of the plurality of layers including the Si layer may be constituted as the vibrating portion 42. In the second region B of the second embodiment, the vibrating portion 42 extends between the first flow path member 30 and the second flow path member 48.

In addition, as illustrated in FIG. 10, a heat transfer material G' may be interposed between the wiring substrate 45 and a wall surface on the second circulation flow path R2 side in the accommodation space G. The heat transfer material G' is, for example, insulating oil such as silicone oil. In this case, the first flow path member 30 and the second flow path member 48 are formed of a material having high rigidity such as stainless steel (SUS), and a portion between an inner wall of the accommodation space G and the wiring substrate 45 is filled with silicone oil.

In FIG. 10, a case where the heat transfer material G' is interposed at a position where the second wiring 466*b* and the second connection terminal 464*b* overlap in plan view (viewed in the Z direction) is exemplified. A wall partitioning a space which is filled with the heat transfer material G' is provided in the accommodation space G to fill the space with the heat transfer material G'. Therefore, the heat of the second wiring 466*b* and the second connection terminal 464*b* is likely to be released to the second circulation flow path R2 via heat transfer material G'. Specifically, the heat transfer material G' is interposed in a portion close to the second wiring 466*b* and the second connection terminal 464*b* which are more likely to generate heat than the first wiring 466*a* and the first connection terminal 464*a*, so that it is possible to improve the cooling efficiency of the wiring substrate 45. Moreover, the heat transfer material G' may be interposed in an entire space between the wall surface of the accommodation space G and the wiring substrate 45.

In addition, as illustrated in FIGS. 10 and 11, the first connection terminal 464*a* is closer to the first individual flow path C1 than to the first circulation flow path R1 as viewed in the Z direction, and the second connection terminal 464*b* is closer to the second individual flow path C2 than to the second circulation flow path R2 as viewed in the first direction. According to such a configuration, the heat of the first connection terminal 464*a* is likely to be radiated to the first circulation flow path R1 via first individual flow path C1, and the heat of the second connection terminal 464*b* is likely to be radiated to the second circulation flow path R2 via second individual flow path C2.

In addition, since the first individual flow path C1 is not formed in a region M1 between the first individual flow paths C1 of the first flow path member 30 illustrated in FIG. 11 on which the first connection terminal 464*a* is stacked as viewed in the Z direction, the region M1 has a strength higher than that of a region in which the first individual flow path C1 is formed. In addition, since the second individual flow path C2 is not formed in a region M2 between the second individual flow paths C2 of the first flow path member 30 illustrated on which the second connection terminal 464*b* is stacked as viewed in the Z direction, the region M2 has a strength higher than that of a region in which the second individual flow path C2 is formed. In a case where the wiring substrate 45 is mounted by pressing the first connection terminal 464*a* and the second connection terminal 464*b* against the first flow path member 30, the strength required for a region of the first flow path member 30 that receives a pressing force from the first connection terminal 464*a* and the second connection terminal 464*b* by materials of the first connection terminal 464*a* and the second connection terminal 464*b*. For example, in a case where the first connection terminal 464*a* and the second connection terminal 464*b* are constituted of metal bumps, the pressing force is larger than that of a case of being constituted resin bumps.

In the second embodiment, the first connection terminals 464*a* include the first connection terminal 464*a* which stacks in the region M1 of the first flow path member 30 between the first individual flow paths C1 as viewed in the Z direction, and the second connection terminals 464*b* include the second connection terminal 464*b* which stacks in the region M2 of the first flow path member 30 between the second individual flow paths C2 as viewed in the Z direction. Therefore, according to the second embodiment, it is possible to increase the strength of the region M1 receiving the pressing force from the first connection terminal 464*a* and the region M2 receiving the pressing force from the second connection terminal 464*b*. Therefore, it is possible to increase a degree of freedom in selecting materials of the first connection terminal 464*a* and the second connection terminal 464*b*.

Third Embodiment

A third embodiment of the invention will be described. In the first embodiment and the second embodiment, a case where the protection substrate 46 and the driving IC 47 are stacked as separated bodies to constitute the wiring substrate 45 is exemplified. In the third embodiment, a case where a protection substrate 46 and a driving IC 47 integrally constitute a wiring substrate 45 is exemplified.

Figure 14:
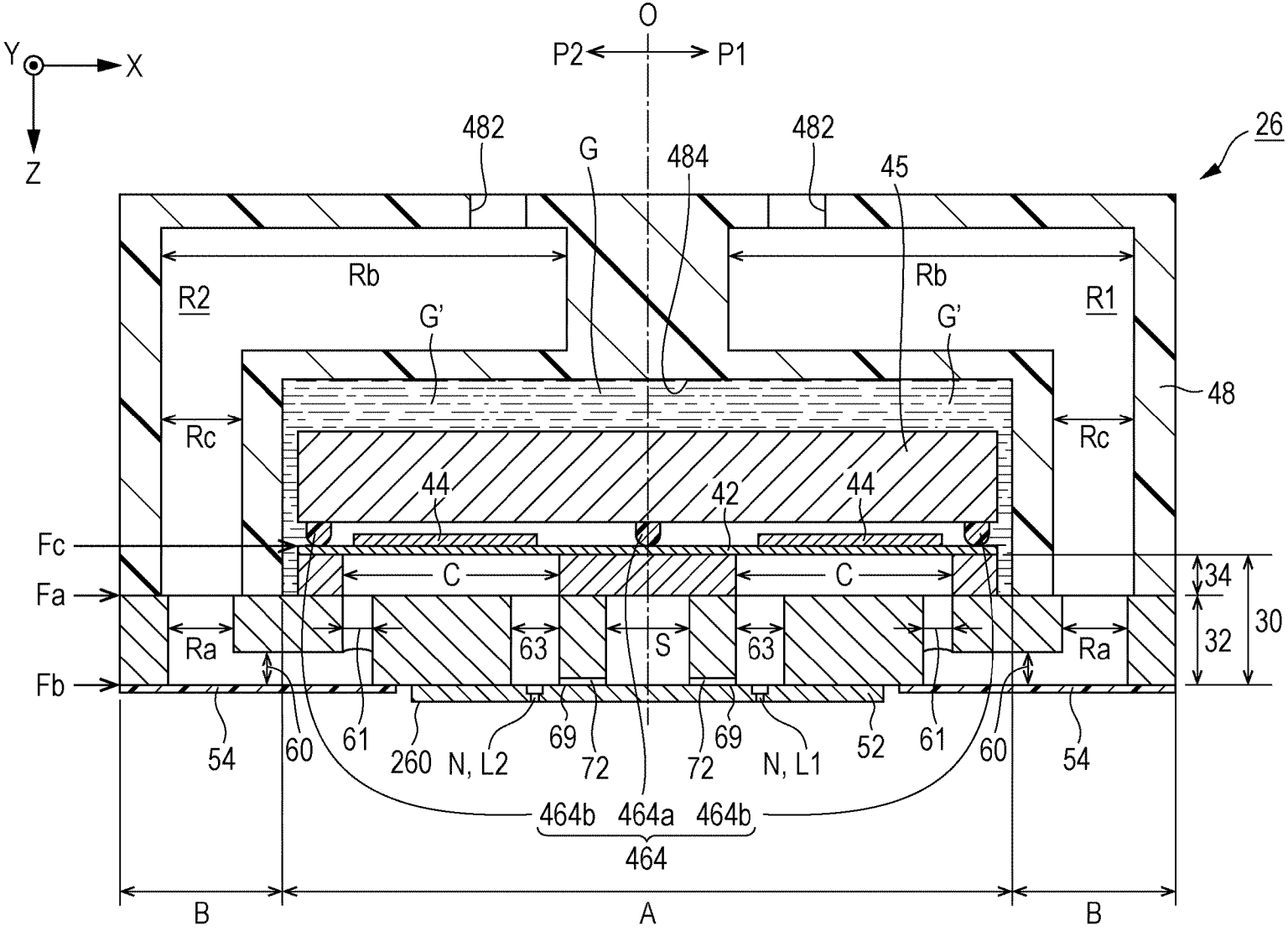
FIG. 14 is a sectional view illustrating a configuration of a liquid discharging head according to a third embodiment.

FIG. 14 is a sectional view illustrating a configuration of a liquid discharging head 26 according to the third embodiment and corresponds to FIG. 3. The wiring substrate 45 of FIG. 14 is stacked on a side of a first flow path member 30 on a side opposite to a pressure chamber C to seal an installation space 462 of a piezoelectric element 44. According to such a configuration, since the wiring substrate 45 of FIG. 14 also functions as the protection substrate 46 of FIG. 3, the first wiring 466*a* and the second wiring 466*b* formed in the protection substrate 46 are unnecessary, and the wiring substrate 45 can be directly connected to an electrode of the piezoelectric element 44 by the connection terminal 464 (first connection terminal 464*a* and second connection terminal 464*b*).

As described above, according to the configuration of FIG. 14, since it is possible to seal the installation space 462 of the piezoelectric element 44 without the protection substrate 46, the heat of the second connection terminal 464*b* can be released to a first circulation flow path R1 or a second circulation flow path R2 while protecting the piezoelectric element 44. In addition, since it is not necessary to provide the protection substrate 46, the number of components can be reduced and the liquid discharging head 26 can be reduced in size in the Z direction. Moreover, as illustrated in FIG. 14, a heat transfer material G' may be interposed in an entire space between a wall surface of an accommodation space G and the wiring substrate 45. Therefore, it is possible to improve the cooling efficiency of the entire wiring substrate 45. Modification Examples The aspects and embodiments described above can be variously modified. Specific aspects of modification are exemplified below. Two or more aspects arbitrarily selected from the following examples and the above-described aspects can be appropriately merged within a scope not inconsistent with each other.

(1) In the embodiments described above, a serial head that causes the carriage 242 on which the liquid discharging head 26 is loaded to repeatedly reciprocate in the X direction is exemplified, but the invention can also be applied to a line head in which the liquid discharging heads 26 are arranged over an entire width of the medium 12.

(2) In the embodiments described above, the piezoelectric type liquid discharging head 26 using the piezoelectric element that applies mechanical vibration to the pressure chamber as a driving element is exemplified, but it is possible to adopt a thermal type liquid discharging head using a heating element to generate bubbles by heating in the pressure chamber as a driving element.

(3) The liquid discharging apparatus 100 exemplified in the embodiments described above can be adopted in various apparatuses such as a facsimile apparatus and a copying machine in addition to the apparatus dedicated to printing. However, the application of the liquid discharging apparatus 100 of the invention is not limited to printing. For example, a liquid discharging apparatus that discharges a solution of a coloring material is used as a manufacturing apparatus that forms a color filter, an organic electro luminescence (EL) display, a surface emitting display (FED), and the like of a liquid crystal display apparatus. In addition, a liquid discharging apparatus for discharging a solution of a conductive material is used as a manufacturing apparatus for forming wiring and an electrode of a wiring substrate. In addition, it is also used as a chip manufacturing apparatus for discharging a solution of bioorganic matter as a kind of liquid.

The present application is based on, and claims priority from JP Application Serial Number 2018-053278, filed Mar. 20, 2018, the disclosure of which is hereby incorporated by reference herein in its entirety.

What is claimed is:

1. A liquid discharging head comprising:

a first flow path member comprising a first flow path and a pressure chamber communicating with a nozzle for discharging a liquid;

a second flow path member stacked on the first flow path member so as to overlap each other in a first direction and comprising a second flow path;

a wiring substrate comprising a connection terminal electrically connected to a driving element to generate a pressure change in the pressure chamber; and a circulation flow path for circulating the liquid through the pressure chamber, wherein a surface of the first flow path member includes a first region and a second region, the first region being stacked on the wiring substrate and not stacked directly on the second flow path member, and the second region being directly stacked on the second flow path member, and wherein the first flow path and the second flow path are in communication with each other in the second region so as to be the circulation flow path.

2. The liquid discharging head according to claim 1, wherein the circulation flow path includes a first circulation flow path and a second circulation flow path which are separated from each other in a second direction intersecting the first direction, and wherein the wiring substrate is disposed between the first circulation flow path and the second circulation flow path in the second direction.

3. The liquid discharging head according to claim 2, wherein a plurality of the pressure chambers are disposed in a third direction intersecting the first direction and the second direction, wherein the first circulation flow path and the second circulation flow path are continuous over the plurality of pressure chambers in the third direction, and wherein each of the plurality of pressure chambers is disposed between the first circulation flow path and the second circulation flow path in the second direction.

4. The liquid discharging head according to claim 3, wherein each of the first circulation flow path and the second circulation flow path includes a first-direction flow path extending in the first direction and a second-direction flow path extending in the second direction, and wherein the second-direction flow path of the first circulation flow path or the second-direction flow path of the second circulation flow path overlaps the connection terminal as viewed in the first direction.

5. The liquid discharging head according to claim 2, wherein the driving element is disposed corresponding to each of the pressure chambers, wherein the connection terminal includes a first connection terminal through which a common potential is applied to each of the driving elements and a second connection terminal through which an individual potential is applied to each of the driving elements, wherein the first circulation flow path is a flow path that allows the liquid to flow into the pressure chamber, wherein the second circulation flow path is a flow path that allows the liquid to flow out from the pressure chamber, and wherein the second connection terminal rather than the first connection terminal is located at a position closer to the second circulation flow path than to the first circulation flow path in the second direction.

6. The liquid discharging head according to claim 5, wherein the second circulation flow path includes a first-direction flow path extending in the first direction and a second-direction flow path extending in the second direction, and wherein the second flow path overlaps the second connection terminal as viewed in the first direction.

7. The liquid discharging head according to claim 5, wherein an accommodation space is formed between the first flow path member and the second flow path member so as to overlap the first region in plan view, wherein the wiring substrate is disposed in the accommodation space, and wherein in the accommodation space, a heat transfer material is interposed between the wiring substrate and a wall surface on a second circulation flow path side.

8. The liquid discharging head according to claim 5, wherein a first individual flow path for connecting each of the pressure chambers and the first circulation flow path to each other and a second individual flow path for connecting each of the pressure chambers and the second circulation flow path to each other are formed in the first flow path member, wherein the first connection terminal is closer to the first individual flow path than to the first circulation flow path as viewed in the first direction, and wherein the second connection terminal is closer to the second individual flow path than to the second circulation flow path as viewed in the first direction.

9. The liquid discharging head according to claim 8, wherein the first connection terminal includes the first connection terminal overlapping a region between the first individual flow paths in the first flow path member as viewed in the first direction, and wherein the second connection terminal includes the second connection terminal overlapping a region between the second individual flow paths in the first flow path member as viewed in the first direction.

10. The liquid discharging head according to claim 1, wherein the second flow path member is provided with a flow path for supplying the liquid to the pressure chamber and a flow path for allowing the liquid to flow out from the pressure chamber in the circulation flow path.

11. A liquid discharging apparatus comprising:

the liquid discharging head according to claim 1.

12. A liquid discharging apparatus comprising:

the liquid discharging head according to claim 2.

13. A liquid discharging apparatus comprising:

the liquid discharging head according to claim 3.

14. A liquid discharging apparatus comprising:

the liquid discharging head according to claim 4.

15. A liquid discharging apparatus comprising:

the liquid discharging head according to claim 5.

16. A liquid discharging apparatus comprising:

the liquid discharging head according to claim 10.

17. The liquid discharging head according to claim 1, wherein a bottom of the wiring substrate faces the first flow path member, a top of the wiring substrate faces the second flow path member, and a side of the wiring substrate faces the second flow path member and does not face the first flow path member.

18. The liquid discharging head according to claim 1, wherein the first flow path member comprises a communication plate that has the first flow path and a pressure chamber substrate that has the pressure chamber.

19. The liquid discharging head according to claim 18, wherein the first region is located on the pressure chamber substrate, and wherein the second region is located on the communication plate.

20. The liquid discharging head according to claim 1, wherein the wiring substrate comprises a driving IC that generates a driving signal.

* * * * *